US012376642B2

(12) United States Patent
Bishop et al.

(10) Patent No.: US 12,376,642 B2
(45) Date of Patent: Aug. 5, 2025

(54) VACUUM LOCKING FOR ARTICLE OF FOOTWEAR OR APPAREL

(71) Applicant: NIKE, Inc., Beaverton, OR (US)

(72) Inventors: Jennifer L. Bishop, Portland, OR (US); Timothy P. Hopkins, Tustin, CA (US); Nicholas R. Long, Portland, OR (US); Todd W. Miller, Portland, OR (US); Austin J. Orand, Portland, OR (US); Nadia M. Panian, Beaverton, OR (US); Aaron K. Seid, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 81 days.

(21) Appl. No.: 18/068,035

(22) Filed: Dec. 19, 2022

(65) Prior Publication Data

US 2023/0189907 A1 Jun. 22, 2023

Related U.S. Application Data

(60) Provisional application No. 63/292,295, filed on Dec. 21, 2021.

(51) Int. Cl.
*A43B 7/1464* (2022.01)

(52) U.S. Cl.
CPC ..... *A43B 7/1464* (2022.01)

(58) Field of Classification Search
CPC ..... A43B 13/20; A43B 13/206; A43B 13/185
See application file for complete search history.

(56) References Cited

U.S. PATENT DOCUMENTS

| | | | | |
|---|---|---|---|---|
| 7,131,218 | B2 * | 11/2006 | Schindler | A43B 13/20 36/35 B |
| 2003/0097767 | A1 * | 5/2003 | Perkinson | A43B 7/144 36/25 R |
| 2004/0003517 | A1 * | 1/2004 | Marvin | A43B 7/084 36/29 |
| 2012/0167413 | A1 | 7/2012 | Marvin et al. | |
| 2016/0122493 | A1 | 5/2016 | Farris et al. | |
| 2016/0242502 | A1 | 8/2016 | Spanks | |
| 2017/0042286 | A1 * | 2/2017 | Meschter | A43B 13/04 |
| 2018/0064207 | A1 * | 3/2018 | Hurd | A43B 13/188 |

(Continued)

FOREIGN PATENT DOCUMENTS

| | | |
|---|---|---|
| WO | WO-2016100170 A1 | 6/2016 |
| WO | WO-2017023532 A1 | 2/2017 |

OTHER PUBLICATIONS

European Patent Office (ISA), International Search Report and Written Opinion for PCT App. No. PCT/US2022/082024, mailed Apr. 18, 2023.

(Continued)

*Primary Examiner* — Jillian K Pierorazio
(74) *Attorney, Agent, or Firm* — Honigman LLP; Matthew H. Szalach; Jonathan P. O'Brien

(57) ABSTRACT

A locking structure for an article includes a bladder having a first barrier element attached to a second barrier element to define a chamber including an interior void and a plurality of locking elements disposed within the interior void and each attached to at least one of the first barrier element and the second barrier element, each of the locking elements including an interface surface operable to selectively engage an interface surface of another one of the locking elements.

10 Claims, 29 Drawing Sheets

(56) References Cited

U.S. PATENT DOCUMENTS

| | | | | |
|---|---|---|---|---|
| 2018/0110286 | A1 | 4/2018 | Vuong | |
| 2019/0216167 | A1* | 7/2019 | Hoffer | A43B 13/04 |
| 2019/0261739 | A1* | 8/2019 | Taylor | A43B 13/206 |
| 2020/0037705 | A1* | 2/2020 | Frank | A43B 13/125 |
| 2021/0114507 | A1* | 4/2021 | Alexander | B60P 7/04 |
| 2021/0120915 | A1 | 4/2021 | Panian | |
| 2021/0235819 | A1 | 8/2021 | Andreasen et al. | |
| 2021/0244128 | A1 | 8/2021 | Costa et al. | |
| 2022/0104582 | A1 | 4/2022 | Christensen et al. | |
| 2022/0395058 | A1* | 12/2022 | Petrie | A43B 13/203 |

OTHER PUBLICATIONS

European Patent Office as ISA, International Search Report and Written Opinion for PCT App. No. PCT/US2022/024763, mailed Jun. 20, 2022.

USPTO, Final Office Action for U.S. Appl. No. 17/719,861, mailed Apr. 11, 2024.

European Patent Office (ISA), International Search Report and Written Opinion for PCT App. No. PCT/US2023/019734, mailed Aug. 2, 2023.

* cited by examiner

VACUUM LOCKING FOR ARTICLE OF FOOTWEAR OR APPAREL

CROSS-REFERENCE TO RELATED APPLICATIONS

This non-provisional U.S. Patent Application claims priority under 35 U.S.C. § 119(e) to U.S. Provisional Patent Application Ser. No. 63/292,295, filed Dec. 21, 2021, the disclosure of which is hereby incorporated by reference in its entirety.

FIELD

The present disclosure relates generally to a locking device for an article of apparel or footwear.

BACKGROUND

This section provides background information related to the present disclosure and is not necessarily prior art.

Articles of apparel, such as garments and headwear, and articles of footwear, such as shoes and boots, typically include a receptacle for receiving a body part of a wearer. For example, an article of footwear may include an upper and a sole structure that operate to form a receptacle for receiving a foot of a wearer. Likewise, garments and headwear may include one or more pieces of material formed into a receptacle for receiving a torso or head of a wearer.

Articles of apparel or footwear are typically adjustable and/or include a relatively flexible material to allow the article of apparel or footwear to accommodate various sizes of wearers, or to provide different fits on a single wearer. While conventional articles of apparel and articles of footwear are adjustable, such articles do not typically allow a wearer to lock the size or shape of the article to a body part of the wearer. For example, while laces adequately secure an article of footwear to a wearer by contracting or constricting a portion of an upper around the wearer's foot, the laces do not cause the upper to lock in a size or shape conforming to the user's foot. Accordingly, an optimum fit of the upper around the foot is difficult to achieve.

BRIEF DESCRIPTION OF DRAWINGS

The drawings described herein are for illustrative purposes only of selected configurations and not all possible implementations, and are not intended to limit the scope of the present disclosure.

FIG. 1013 is a cross-sectional view of the locking structure of FIG. 10A, taken along Line 106-106 of FIG. 10A;

FIG. 126 is a cross-sectional view of the locking structure of FIG. 12A, taken along Line 126-126 of FIG. 12A;

Corresponding reference numerals indicate corresponding parts throughout the drawings.

DETAILED DESCRIPTION

Figure 1A:
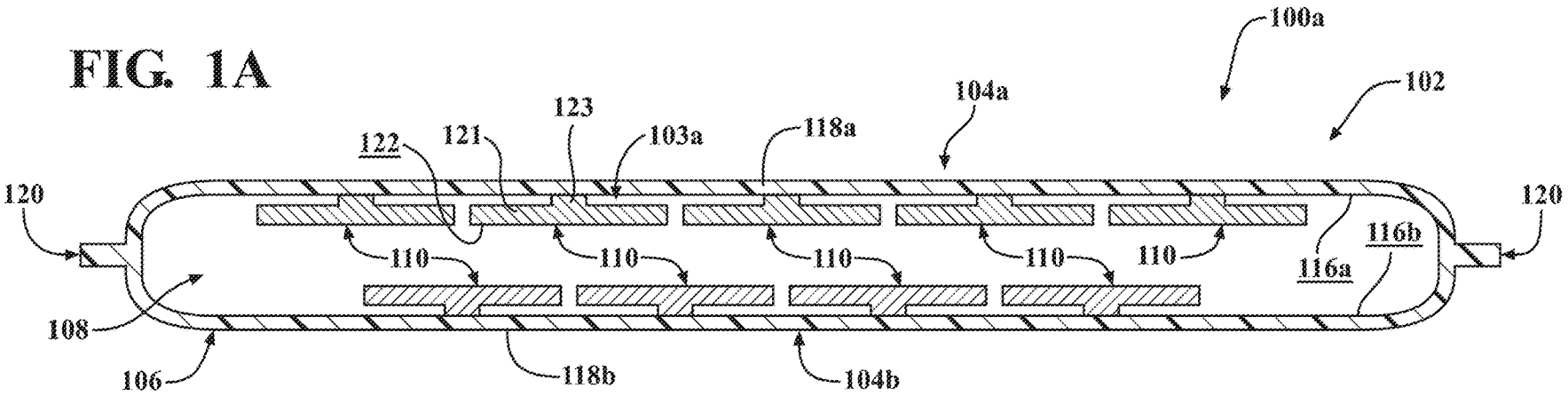
FIG. 1A is an example of a locking structure according to the present disclosure, where the locking structure is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a locking structure for an article includes a bladder having a first barrier element attached to a second barrier element to define a chamber including an interior void and a plurality of locking elements disposed within the interior void and each attached to at least one of the first barrier element and the second barrier element, each of the locking elements including an interface surface operable to selectively engage an interface surface of another one of the locking elements.

The locking structure may include one or more of the following optional features. For example, each of the locking elements may include an anchor attached to an inner surface of one of the first barrier element and the second barrier element. Additionally or alternatively, each of the locking elements may include a locking body having the interface surface. In this configuration, each of the locking elements may include a pair of interface surfaces disposed on opposite sides of the locking body and/or the locking body may be contoured.

In another configuration, a port may be in fluid communication with the interior void and/or a compressible component may be disposed within the interior void. The bladder may include a third barrier element attached to the first barrier element and the second barrier element, the third barrier element formed within the chamber to define a first subchamber having a first interior void and a second subchamber having a second interior void. In this configuration, the plurality of locking elements may be disposed within the first interior void and the compressible component may be disposed within the second interior void. Finally, the first subchamber having the first interior void may include a first port in communication with the first interior void and the second subchamber having the second interior void may include a second port in communication with the second interior void.

In another configuration, a locking structure for an article includes a bladder having a first barrier element attached to a second barrier element to define a chamber including an interior void and a locking system including locking elements each attached to one of the first barrier element or the second barrier element and including at least one interface surface, the interior void of the bladder operable between a first pressure to move the locking system to a locked state and a second pressure to move the locking system to an unlocked state.

The locking structure may include one or more of the following optional features. For example, each of the locking elements may include an anchor attached to an inner surface of one of the first barrier element and the second barrier element. Additionally or alternatively, each of the locking elements may include a locking body having the interface surface. In this configuration, each of the locking elements may include a pair of interface surfaces disposed on opposite sides of the locking body and/or the locking body may be contoured.

In one configuration, a port may be in fluid communication with the interior void. Further, a compressible component may be disposed within the interior void. In this configuration, the bladder may include a third barrier element attached to the first barrier element and the second barrier element, the third barrier element formed within the chamber to define a first subchamber having a first interior void and a second subchamber having a second interior void. The locking system may be disposed within the first interior void and the compressible component may be disposed within the second interior void. The first subchamber having the first interior void may include a first port in communication with the first interior void, and the second subchamber having the second interior void may include a second port in communication with the second interior void.

An upper for an article of footwear may include the foregoing locking structures. Additionally or alternatively, an article of apparel may include the foregoing locking structures.

The details of one or more implementations of the disclosure are set forth in the accompanying drawings and the description below. Other aspects, features, and advantages will be apparent from the description, the drawings, and the claims.

Figure 1B:
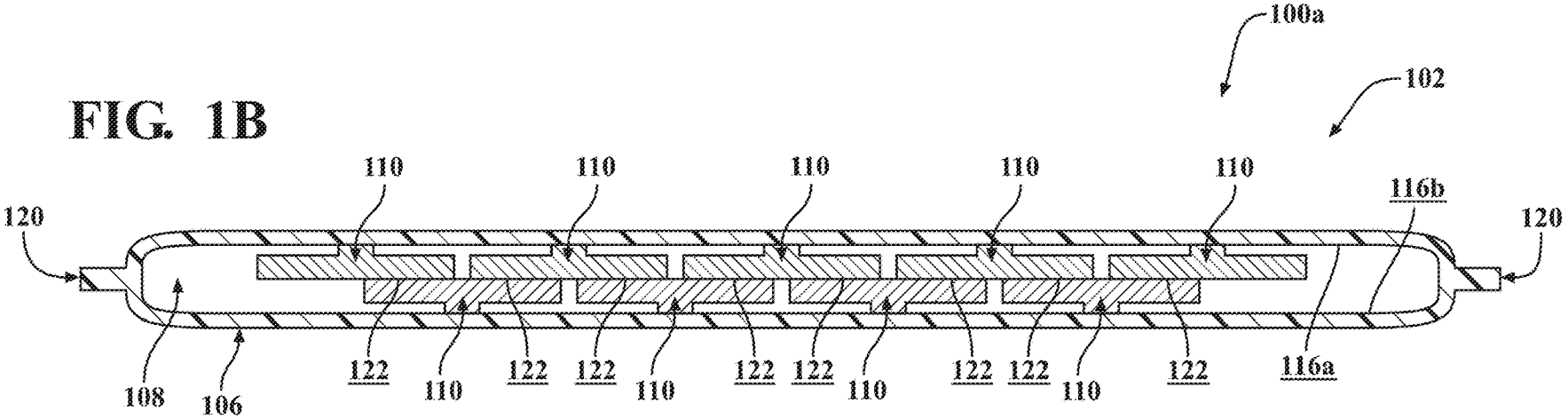
FIG. 1B is an example of the locking structure of FIG. 1A in a locked state.

Referring to FIGS. 1A and 1B, examples of a locking structure 100*a* include a bladder 102 and a locking system 103*a* attached to the bladder 102. The bladder 102 includes a first barrier layer 104*a* (e.g., a first barrier element 104*a*) attached to a second barrier layer 104*b* (e.g., a second barrier element 104*b*) formed on an opposite side of the bladder 102 from the first barrier layer 104*a*. A distance from the first barrier layer 104*a* and the second barrier layer 104*b* defines a thickness of the bladder 102. The first barrier layer 104*a* and the second barrier layer 104*b* cooperate to define a chamber 106 having an interior void 108.

The locking system 103*a* includes a plurality of locking elements 110 attached to at least one of the first barrier layer 104*a* and the second barrier layer 104*b* to form the locking system 103. As discussed in greater detail below, the plurality of locking elements 110 are operable to transition the locking system 103*a* of the locking structure 100*a*-100*f* between an unlocked state (FIG. 1A), where the bladder 102 is free to stretch and conform around the wearer, and a locked state (1B), where the bladder 102 is restricted or locked from stretching or conforming. Each locking element 110 includes a locking body 121 having a first side and a second side. The first side of the locking body 121 defines an interface surface 122, discussed in greater detail below, and the second side of the locking body 121 includes an anchor 123 for attaching the locking element 110 to one of the barrier layers 104*a*, 104*b*.

In the illustrated examples, the first barrier layer 104*a* includes a first inner surface 116*a* and a first outer surface 118*a*, and the second barrier layer 104*b* includes a second inner surface 116*b* and a second outer surface 118*b*. The first inner surface 116*a* and the second inner surface 116*b* face each other and are joined to each other at discrete locations to form a peripheral seam 120.

As used herein, the term "barrier layer" (e.g., barrier layers 104*a*, 104*b*) encompasses both monolayer and multilayer films. In some embodiments, one or both of the barrier layers 104*a*, 104*b* are each produced (e.g., thermoformed or blow molded) from a monolayer film (a single layer). In other embodiments, one or both of the barrier layers 104*a*, 104*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 104*a*, 104*b* can independently be transparent, translucent, and/or opaque. As used herein, the term "transparent" for a barrier layer and/or a chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 104*a*, 104*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocyanurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocyanates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 104*a*, 104*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 104*a*, 104*b* include two or more sublayers, examples of suitable multilayer films include microlayer films, such as those disclosed in Bonk et al., U.S. Pat. No. 6,582,786, which is incorporated by reference in its entirety. In further embodiments, the barrier layers 104*a*, 104*b* may each independently include alternating sublayers of one or more TPU copolymer materials and one or more EVOH copolymer materials, where the total number of sublayers in each of the barrier layers 104*a*, 104*b* includes at least four (4) sublayers, at least ten (10) sublayers, at least twenty (20) sublayers, at least forty (40) sublayers, and/or at least sixty (60) sublayers.

The chamber 106 can be produced from the barrier layers 104*a*, 104*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 104*a*, 104*b* can be produced by co-extrusion followed by vacuum thermoforming to produce an inflatable chamber 106, which can optionally include one or more valves (e.g., one way valves) that allows the chamber 106 to be filled with a fluid (e.g., gas).

The chamber 106 can be provided in a fluid-filled (e.g., as provided in footwear 10) or in an unfilled state. The chamber 106 can be filled to include any suitable fluid, such as a gas or liquid. In an aspect, the gas can include air, nitrogen (N2), or any other suitable gas. The fluid provided to the chamber 106 can result in the chamber 106 being pressurized. Alternatively, the fluid provided to the chamber 106 can be at atmospheric pressure such that the chamber 106 is not pressurized but, rather, simply contains a volume of fluid at atmospheric pressure.

The chamber 106 desirably has a low gas transmission rate to preserve its retained gas pressure. In some embodiments, the chamber 106 has a gas transmission rate for nitrogen gas that is at least about ten (10) times lower than a nitrogen gas transmission rate for a butyl rubber layer of substantially the same dimensions. In an aspect, chamber 106 has a nitrogen gas transmission rate of 15 cubic-centimeter/square-meter·atmosphere·day (cm3/m2·atm·day) or less for an average film thickness of 500 micrometers (based on thicknesses of the barrier layers 104*a*, 104*b*). In further aspects, the transmission rate is 10 cm3/m2·atm·day or less, 5 cm3/m2·atm·day or less, or 1 cm3/m2·atm·day or less.

In some implementations, the first barrier layer 104*a* and the second barrier layer 104*b* cooperate to define a geometry (e.g., thicknesses, width, and lengths) of the chamber 106. The peripheral seam 120 may extend around the chamber 106 to seal the fluid (e.g., air) within the chamber 106. Thus, the chamber 106 is associated with an area of the bladder 102 where inner surfaces 116*a*, 116*b* of the first and second barrier layers 104*a*, 104*b* are not joined together and, thus, are separated from one another.

In some examples, the barrier layers 104*a*, 104*b* may include the same materials to provide the chamber 106 with a homogenous barrier construction, such that both sides of the locking structure 100 will contract and relax at the same rate when pressure within the chamber 106 is adjusted. Alternatively, a first one of the barrier layers 104*a*, 104*b* may be at least partially constructed of a different barrier material and/or configuration than the other one of the barrier layers 104*a*, 104*b* to selectively impart a contour as the locking structure 100 transitions between the relaxed state and the locked state. For example, one of the barrier layers 104*a*, 104*b* may be at least partially formed with a different modulus of elasticity and/or stiffness than the other barrier layer 104*a*, 104*b*, such that when the locking structure 100 transitions from the relaxed state to the locked state, the first one of the barrier layers 104*a*, 104*b* contracts at a different rate than the other barrier layer 104*a*, 104*b* to cause the locking structure 100 to curl.

Each locking element 110 in the plurality of locking elements 110 includes an interface surface 122 configured to cooperate with the interface surface 122 of an opposing one of the locking elements 110 to maintain the locking system 103*a* in the locked state. As discussed in greater detail below, the interface surfaces 122 of the locking elements 110 may include textured and/or high friction materials configured to restrict or prevent relative movement between opposing interface surfaces 122. Accordingly, when the interface surface 122 of one locking element 110 in the plurality of locking elements 110 is in contact with an interface surface 122 of a second locking element 110 in the plurality of locking elements 110, the locking elements 110 cooperate to create a rigid locking layer 112. Examples of different geometries and surface configurations of locking elements 110 are discussed below with respect to FIGS. 7A-7E.

In use, the locking structure 100 is moved between the unlocked state and the locked state by adjusting the fluid pressure within the interior void 108 of the chamber 106. In some examples, the pressure within the interior void 108 can be selectively adjusted from a first pressure (e.g., at or above ambient) to a second pressure (e.g., a pressure below ambient). For example, the pressure within the interior void 108 may be reduced by drawing a vacuum within the interior void through a port 134 (e.g., FIG. 10) attached to the bladder 102. The vacuum may be drawn using a pressure source, such as a pump 136 integrated within the footwear 10 or provided as a peripheral (i.e., independent) accessory to the footwear 10. For illustrative purposes, the pump 136 is shown disposed in the heel region 24 of the sole structure 200 (e.g., FIG. 10). However, the pump 136 may be attached or disposed in any portion of the article of footwear 10, such as on the upper 300 or in other regions of the sole structure 200. Further, the pump 136 may be a peripheral accessory not attached to the shoe, such as a hand pump. As the pressure is reduced (e.g., below ambient) within the interior void 108, the plurality of locking elements 110 are drawn toward one another and lock the locking structure 100 into place (e.g., the locked state). Conversely, to move the locking structure 100 to the relaxed state, the pressure within the interior void 108 is increased and the plurality of locking elements 110 release from one another to allow movement of the locking structure 100.

With continued reference to FIGS. 1A and 1B, locking structure 100*a* includes a plurality of locking elements 110 disposed within the interior void 108 of the chamber 106. As shown, a first plurality of locking elements 110 are disposed on the inner surface 116*a* of the first barrier layer 104*a* and a second plurality of locking elements 110 are disposed on the second inner surface 116*b* of the second barrier layer 104*b*. In some implementations, the plurality of locking elements 110 are integrally formed with the inner surfaces 116*a*, 116*b* of the barrier layers 104*a*, 104*b*. In other implementations, the plurality of locking elements 110 are mechanically attached to the inner surfaces 116*a*, 116*b* of the barrier layers 104*a*, 104*b* (e.g., individually welded).

In FIGS. 1A and 1B, the first plurality of locking elements 110 disposed on the first inner surface 116*a* of the first barrier layer 104*a* oppose the second plurality of locking elements 110 disposed on the second inner surface 116*b* of the second barrier layer 104*b*. While in the relaxed state (FIG. 1A), the interface surfaces 122 of the first plurality of locking elements 110 disposed on the first inner surface 116*a* of the first barrier layer 104*a* are spaced apart and separated from the interface surfaces 122 of the second plurality of locking elements 110 disposed on the second inner surface 116*b* of the second barrier layer 104*b*. When the pressure in the interior void 108 of the chamber 106 is reduced from a first pressure (e.g., at or above ambient) to a second pressure (e.g., below ambient), the inner surfaces 116*a*, 116*b* of the barrier layers 104*a*, 104*b* move toward one another to bring the interface surfaces 122 of the first plurality of locking elements 110 into direct contact with the opposing interface surfaces 122 of the second plurality of locking elements 110. Once the first plurality of locking elements 110 are in direct contact with the opposing second plurality of locking elements 110 at the respective interface surfaces 122, the resulting friction between the interface surfaces 122 forms the locking layer 112 that maintains the locking structure 100*a* in the locked state of FIG. 1B.

While in the locked state of FIG. 1B, tensile forces FT applied along the lengths of the barrier layers 104*a*, 104*b* are opposed by the frictional forces between the interface surfaces 122 of the locking elements 110. Thus, the bladder 102 is restricted from stretching or deforming around the wearer when the locking system 103*b* is in the locked state. When the wearer wishes to unlock the locking system 103, such as to loosen the article (e.g., shoe or clothing), the wearer increases the pressure within the interior void 108 of the bladder 102 to move the first barrier layer 104*a* away from the second barrier layer 104*b* (FIG. 1A). Consequently, the interface surfaces 122 of the respective first and second pluralities of the locking elements 110 disengage from each other to allow the barrier layers 104*a*, 104*b* to stretch and deform.

Figure 2A:
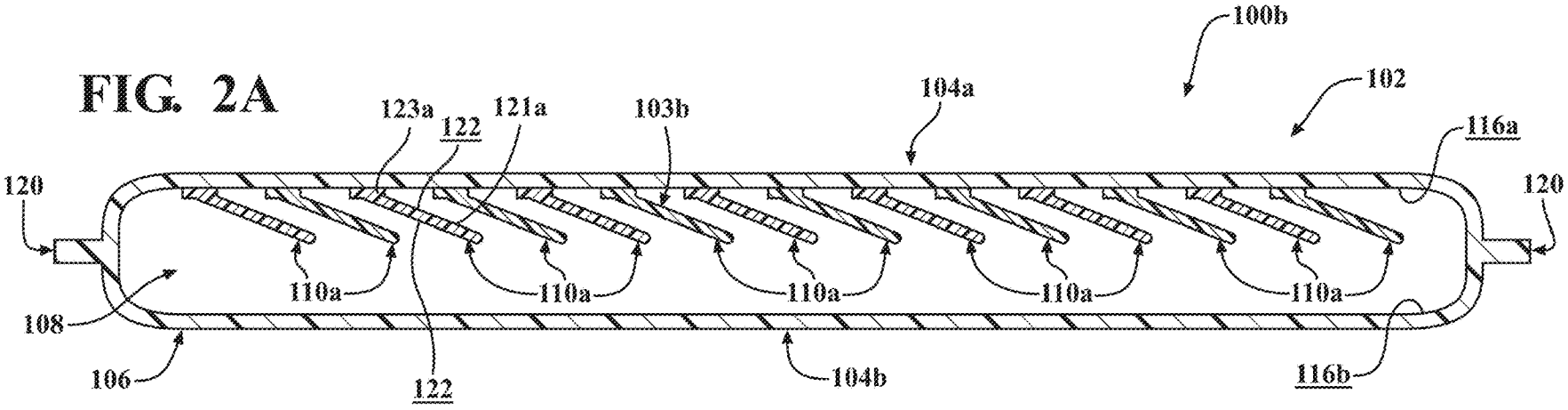
FIG. 2A is an example of a locking structure according to the present disclosure, where the locking structure is in a relaxed state.
Figure 2B:
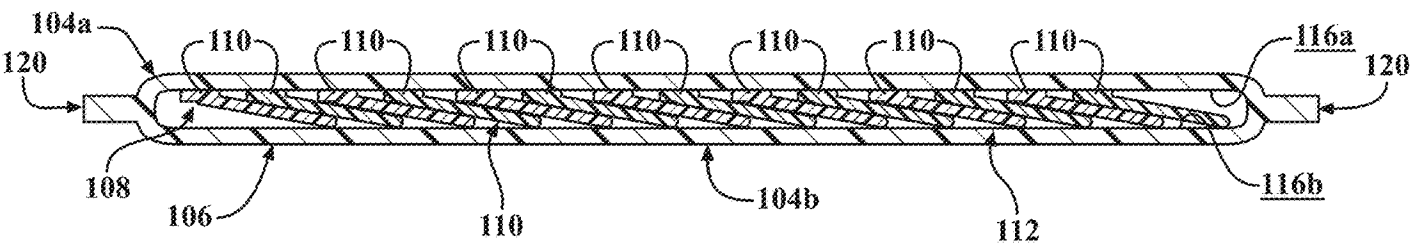
FIG. 2B is an example of the locking structure of FIG. 2A in a locked state.

With particular reference to FIGS. 2A and 2B, a locking structure 100*b* is provided and includes the bladder 102 and a locking system 103*b* disposed within the bladder 102. In view of the substantial similarity in structure and function of the components associated with the locking structure 100*a* with respect to the locking structure 100*b*, like reference numerals are used hereinafter and in the drawings to identify like components while like reference numerals containing letter extensions are used to identify those components that have been modified.

Referring to FIGS. 2A and 2B, the locking system 103*b* includes a plurality of locking elements 110*a* disposed within the interior void 108 of the chamber 106. In this example, the plurality of locking elements 110*a* are only disposed on one of the inner surfaces 116*a*, 116*b* of the barrier layers 104*a*, 104*b*. As shown, the plurality of locking elements 110*a* are disposed on the inner surface 116*a* of the first barrier layer 104*a* in FIG. 2A. In some implementations, the plurality of locking elements 110*a* are integrally formed with the inner surfaces 116*a*, 116*b* of the barrier layers 104*a*, 104*b*. In other implementations, the plurality of locking elements 110*a* are mechanically attached to the inner surfaces 116*a*, 116*b* of the barrier layers 104*a*, 104*b* (e.g., individually welded).

Unlike the example of FIGS. 1A and 1B, where the locking elements 110 are attached to each barrier layer 104*a*, 104*b* and each include the interface surface 122 on one side, the locking elements 110*a* of the present example includes a pair of the interface surfaces 122 disposed on opposite sides of the locking element 110*a*. Here, the locking elements 110*a* include a locking body 121*a* including the interface surfaces 122 disposed on opposite sides of the locking body 121*a*. The locking elements 110*a* also include an anchor 123*a* disposed at one end of the locking body 121*a*. The anchor 123*a* attaches to the inner surface 116*a*, 116*b* of one of the barrier layers 104*a*, 104*b* such that the locking body 121*a* extends from the anchor 123*a* to a free end disposed at an opposite end from the anchor 123*a*. FIGS. 1A and 1B are illustrated with the locking elements 110*a* of FIG. 7A, but may include any one or more of the other locking elements 110*b*-110*e* as provided in FIGS. 7B-7E.

While in a relaxed state (FIG. 2A), the locking bodies 121*a* of adjacent ones of the plurality of locking elements 110*a* disposed on the inner surface 116*a* of the first barrier layer 104*a* are arranged in a spaced apart manner to prevent direct contact between the interface surfaces 122 of the plurality of locking elements 110*a*. In this relaxed state, the locking structure 100*b* is relatively flexible and can conform and stretch to fit a variety of geometries. When the pressure of the interior void 108 of the chamber 106 is reduced from a first pressure (e.g., ambient) to a second pressure (e.g., below ambient), the inner surfaces 116*a*, 116*b* of the barrier layers 104*a*, 104*b* move toward one another to bring the plurality of locking elements 110*a* into direct contact with one another at the interface surfaces 122 where each locking element 110*a* in the plurality of locking elements 110 overlaps adjacent locking elements 110. Thus, the interface surface 122 on a first side of a first one of the locking body 121*a* of one of the locking elements 110*a* will engage the opposing interface surface 122 on the second side of the locking body 121*a* of an adjacent one of the locking element 110*a*. Once the plurality of locking elements 110*a* are in overlapping direct contact with one another at their respective interface surfaces 122, the resulting friction between the interface surfaces 122 forms the locking layer 112 that maintains the locking structure 100*b* in the locked state in FIG. 2B.

Optionally, the locking system 103*b* shown in FIGS. 2A and 2B may be provided in a force-responsive configuration that does not utilize vacuum. Here, the locking system 103*b* is configured to lock in response to reactive forces applied to the locking system 103*b* by the foot. For example, during low-energy movements (e.g., walking) the elastic forces of the materials of the barrier layers 104*a*, 104*b* may bias the locking system 103*b* towards a contracted, unlocked state. However, during high-energy movements (e.g., cutting, stopping, starting), the barrier layers 104*a*, 104*b* may stretch in response to forces applied to the shoe upper. As the barrier layers 104*a*, 104*b* are stretched around the foot, the locking elements 110 are collapsed upon each other to form a locking interface, thereby limiting the amount of stretch in the barrier layers 104*a*, 104*b*. Thus, unlike applications including a vacuum locking configuration, in which the locking system 103*b* is continuously locked under the force of vacuum, force-responsive configurations are tuned to lock in response to threshold forces caused by movements of the foot. The threshold forces for locking and unlocking the locking system 103*b* may be turned by modifying the spacing, quantity, size, shape, and/or surface textures of the locking elements. Optionally, the locking system 103*b* may be implemented on a single one of the barrier layers 104*a*, 104*b* or on another resilient substrate (e.g., an elastic fabric).

Figure 3A:
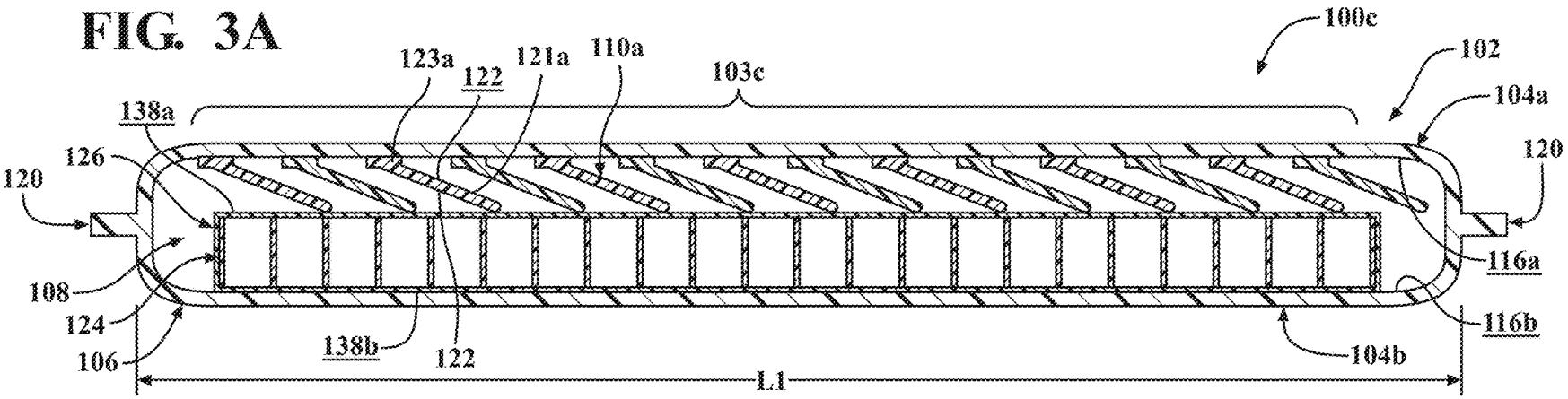
FIG. 3A is an example of a locking structure according to the present disclosure, where the locking structure is in a relaxed state.
Figure 3B:
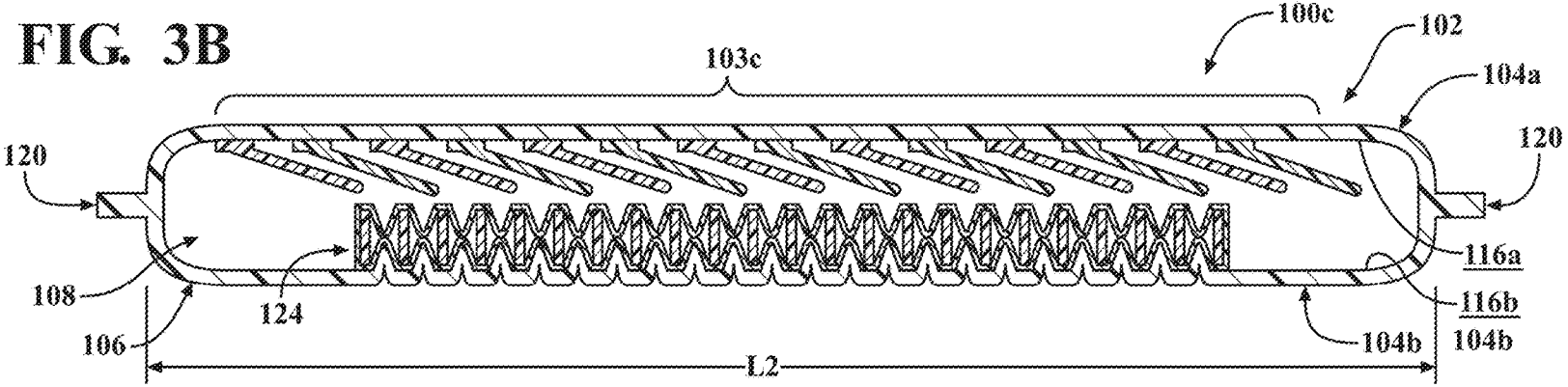
FIG. 3B is an example of the locking structure of FIG. 3A in a constricted state.

With particular reference to FIGS. 3A and 3B, a locking structure 100*c* is provided and includes the bladder 102 and a locking system 103*c* disposed within the bladder 102. In view of the substantial similarity in structure and function of the components associated with the locking structure 100*a* with respect to the locking structure 100*c*, like reference numerals are used hereinafter and in the drawings to identify like components while like reference numerals containing letter extensions are used to identify those components that have been modified.

Figure 3C:
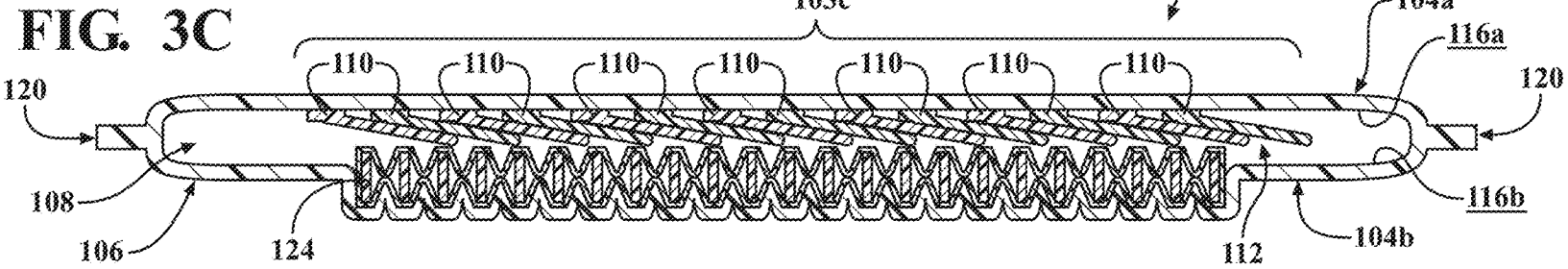
FIG. 3C is an example of the locking structure of FIG. 3B in a locked state.

Referring to FIGS. 3A-3C, in some implementations, the locking structure 100*c* includes a plurality of the locking elements 110*a* and a compressible component 124 disposed within the interior void 108 of the chamber 106. The compressible component 124 is a transformable structure operable to transition between a relaxed state and a constricted state. Once in the constricted state, the plurality of locking elements 110*a* are operable to transition the locking structure 100*c* between the unlocked state and the locked state. Accordingly, the plurality locking elements 110*a* and the compressible component 124, when disposed within the interior void 108, cooperate to transition the locking structure 100*c* from a relaxed unlocked state, to a constricted unlocked state, to a constricted locked state.

In this example, the compressible component 124 includes a collapsible lattice structure 126 having a plurality of apertures or reliefs formed through a thickness of the compressible component 124. Generally, when a pressure within the interior void 108 of the chamber 106 is reduced from a first pressure (e.g., ambient) to a second pressure, the lattice structure 126 is configured to collapse within the chamber 106 to transition the compressible component 124 from the unlocked and relaxed state (FIG. 3A) to the unlocked and constricted state (FIG. 3B). When the pressure within the interior void 108 of the chamber 106 is further reduced from the second pressure to a third pressure, the plurality of locking elements 110 are brought into contact to form the locking layer 112 associated with the locked state.

As shown, the compressible component 124 includes a first surface 138*a* on a first side of the compressible component 124 and a second surface 138*b* on an opposite second side of the compressible component 124. A distance from the first surface 138*a* to the second surface 138*b* defines a thickness of the compressible component 124. As discussed in greater detail below, the compressible component 124 is operable to further transition the locking structure 100 between a relaxed state (FIG. 3A) and a constricted state (FIG. 3B). The compressible component 124 may be formed of a resilient material, such as a foam material, which is configured to compress within the bladder 102 as pressure within the interior void 108 is reduced and to bias the bladder 102 back towards the expanded or relaxed state when pressure within the interior void 108 is increased.

One of the first surface 138*a* and the second surface 138*b* of the compressible component 124 may be attached to one of the inner surfaces 116*a*, 116*b* of the barrier layers 104*a*, 104*b* when the locking structure 100*c* is assembled. As shown, the second surface 138*b* of the compressible component 124 is attached to the second inner surface 116*b* of the second barrier layer 104*b*. In some implementations, the second surface 138*b* may be fully attached to the second inner surface 116*b*. Thus, as the compressible component 124 moves between the relaxed and constricted state, the compressible component 124 directly pulls the second barrier layer 104*b* to transition the second barrier layer 104*b* between a relaxed and constricted state. While FIGS. 3A-3C show the locking elements 110*a* disposed between the compressible component 124 and the bladder 102 as being attached to the first barrier layer 104*a* of the bladder 102 via the anchors 123*a*, it will be appreciated that the anchors

123*a* of the locking elements 110*a* may alternatively be attached to first surface 138*a* of the compressible component 124.

While in the relaxed state (FIG. 3A), the plurality of locking elements 110*a* are disposed on the first inner surface 116*a* of the first barrier layer 104*a* and are arranged in a spaced apart manner to prevent direct contact between the interface surfaces 122 of the plurality of locking elements 110*a*. In this relaxed state, the locking structure 100*c* is relatively flexible and can conform to a variety of geometries. When the pressure of the interior void 108 of the chamber 106 is reduced from the first pressure (e.g., ambient) to the second pressure (e.g., below ambient), the compressible component 124 constricts and pulls the attached second barrier layer 104*b* to move the locking structure 100*c* from the relaxed state to the constricted state (FIG. 3B). In the illustrated example, the transition from the relaxed state to the constricted state is represented by a change in the overall length of the bladder 102 from a first length L1 in the relaxed state to a smaller second length L2 in the constricted state.

Once in the desired constricted state, the pressure of the interior void 108 of the chamber 106 is further reduced from the second pressure to a third pressure (i.e., a pressure below the second pressure) and the inner surfaces 116*a*, 116*b* of the barrier layers 104*a*, 104*b* move toward one another to bring the plurality of locking elements 110*a* into direct contact with one another at the interface surfaces 122 and with the first surface 138*a* of the constricted compressible component 124. Each locking element 110*a* in the plurality of locking elements 110*a* overlaps adjacent locking elements 110*a*, and once the plurality of locking elements 110*a* are in overlapping direct contact with one another at their respective interface surfaces 122, the resulting friction between the interface surfaces 122 forms the locking layer 112 that maintains the locking structure 100*c* in the constricted state to the locked state (FIG. 3C). Additionally, the interface surfaces 122 of the locking elements 110*a* may engage the first surface 138*a* of the constricted compressible component 124 to maintain the compressible component 124 in the constricted state.

When the wearer wishes to release the locking structure 100*c*, the pressure within the interior void 108 may be increased to the second pressure or the first pressure. For example, returning the pressure within the interior void 108 to the second pressure may maintain the locking structure 100*c* in the constricted state while unlocking the locking system 103*b* to allow the shape of the locking structure 100*c* to be adjusted. Further increasing the pressure within the interior void to the first pressure allows the compressible component 124 to transition to the relaxed state so that the article (e.g., shoe or clothing) can be removed from the wearer.

Figures 4A, 4B, 4C:
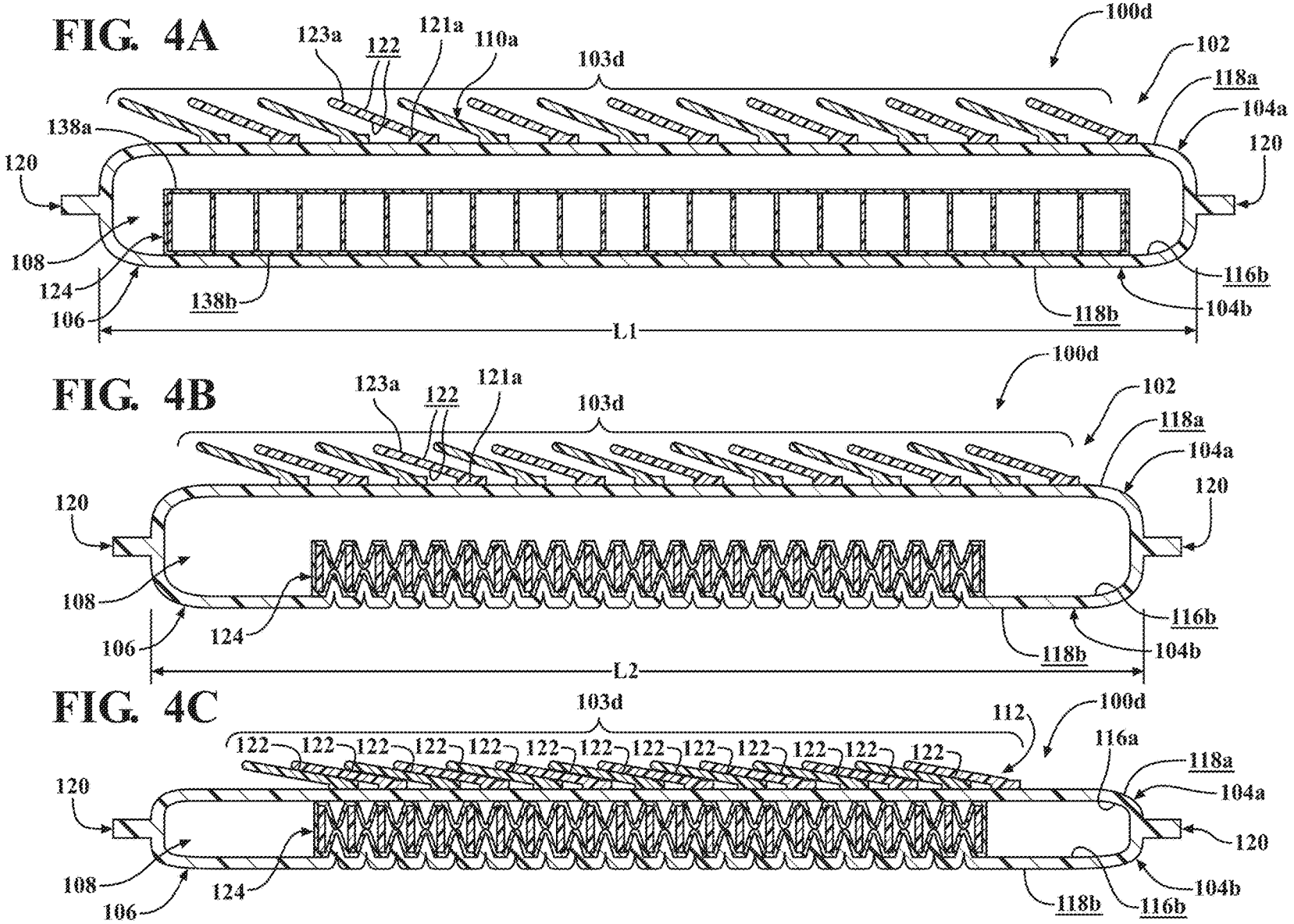
FIG. 4A is an example of a locking structure according to the present disclosure, where the locking structure is in a relaxed state.
FIG. 4B is an example of the locking structure of FIG. 4A in a constricted state.
FIG. 4C is an example of the locking structure of FIG. 4B in a locked state.

With particular reference to FIGS. 4A and 4B, a locking structure 100*d* is provided and includes the bladder 102 and a locking system 103*d* disposed within the bladder 102. In view of the substantial similarity in structure and function of the components associated with the locking structure 100*a* with respect to the locking structure 100*d*, like reference numerals are used hereinafter and in the drawings to identify like components while like reference numerals containing letter extensions are used to identify those components that have been modified.

Referring to FIGS. 4A-4C, in some implementations, locking structure 100*d* includes a plurality of the locking elements 110*a* disposed the outside of the chamber 106 and the compressible component 124 disposed within the interior void 108 of the chamber 106. Like in FIGS. 3A-3C, the compressible component 124 is operable to transition between a relaxed state and a constricted state. Once in the constricted state, the plurality of locking elements 110*a* are operable to transition the locking structure 100*d* between the constricted state and the locked state. Accordingly, the plurality locking elements 110 and the compressible component 124, cooperate to transition the locking structure 100*d* from an unlocked relaxed state, to an unlocked constricted state, to a locked constricted state.

When the plurality of locking elements are disposed on the outer surface 118 of the chamber, one or both surfaces 138*a*, 138*b* of the compressible component 124 may be attached to the corresponding barrier layer 104*a*, 104*b* when the locking structure 100*d* is assembled. In one configuration, one or both of the first surface 138*a* and the second surface 138*b* may be fully attached to the corresponding one of the barrier layers 104*a*, 104*b*. Thus, as the compressible component 124 moves between the relaxed state and the constricted state, the surfaces 138*a*, 138*b* of the compressible component 124 directly pull the barrier layers 104*a*, 104*b* to transition the barrier layers 104*a*, 104*b* between the relaxed state and the constricted state.

In this example, the plurality of locking elements 110*a* are disposed on an outer surface 118 of the barrier layers 104. Each locking element 110*a* in the plurality of locking elements 110*a* may be forced into contact with adjacent locking elements 110*a* based upon a running motion or lateral cut made by an athlete that applies a pressure to the plurality of locking elements 110*a*. For example, the force associated with a foot strike of a gait cycle may apply the pressure necessary to force the plurality of locking elements 110*a* into direct contact with one another at the interface surfaces 122 where each locking element 110*a* in the plurality of locking elements 110 overlaps adjacent locking elements 110*a*. Once the plurality of locking elements 110*a* are in overlapping direct contact with one another at their respective interface surfaces 122, the resulting friction between the interface surfaces 122 forms the locking layer 112 that maintains the locking structure 100*d* in the locked state.

While in a relaxed state (FIG. 4A), the plurality of locking elements 110*a* are disposed on the first outer surface 118*a* of the first barrier layer 104*a* and are arranged in a spaced apart manner to prevent direct contact between the interface surfaces 122 of the plurality of locking elements 110. In this relaxed state, the locking structure 100*d* is relatively flexible and can conform to a variety of geometries. When the pressure of the interior void 108 of the chamber 106 is evacuated from first pressure (e.g., ambient) to a second pressure (e.g., below ambient), the compressible component 124 constricts and pulls the attached second barrier layer 104*b* to move the locking structure 100*d* from the relaxed state to the constricted state (FIG. 4B). In the illustrated example, the transition from the relaxed state to the constricted state is represented by a change in the overall length of the bladder 102 from a first length L1 in the relaxed state to a smaller second length L2 in the constricted state.

When an external pressure is applied to the plurality of locking elements 110*a* (e.g., by the force of a heel strike), the plurality of locking elements 110*a* are moved into direct contact with one another at the interface surfaces 122. Each locking element 110*a* in the plurality of locking elements 110*a* overlaps adjacent locking elements 110, and once the plurality of locking elements 110*a* are in overlapping direct contact with one another at their respective interface surfaces 122, the resulting friction between the interface surfaces 122 forms the locking layer 112 on the outside of the chamber 106 that transitions the locking structure 100*d* from the unlocked and constricted state to the locked and constricted state (FIG. 4C).

Figure 5A:
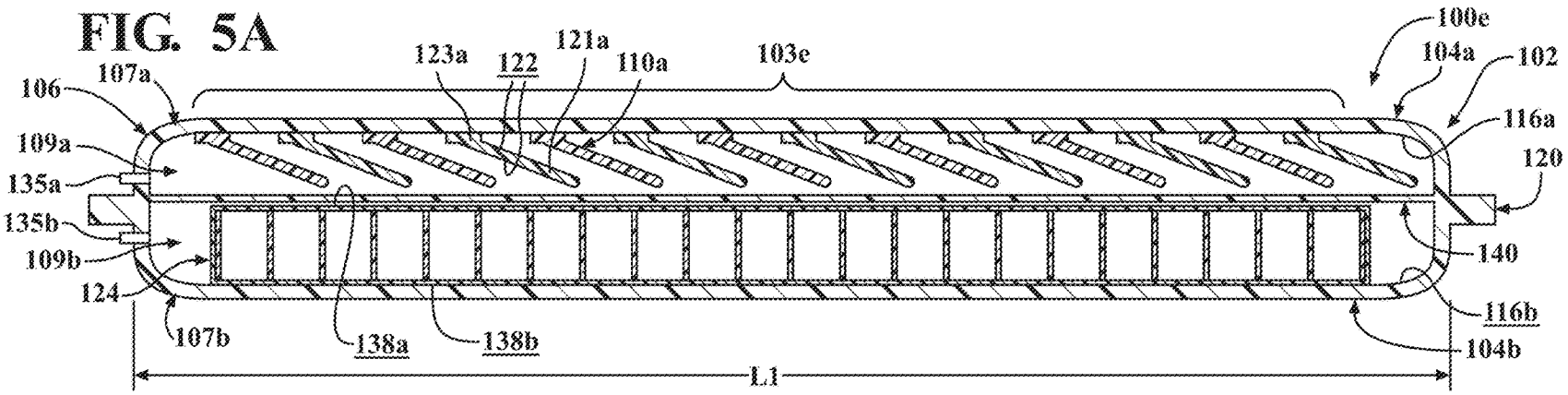
FIG. 5A is an example of a locking structure according to the present disclosure, where the locking structure is in a relaxed state.
Figure 5B:
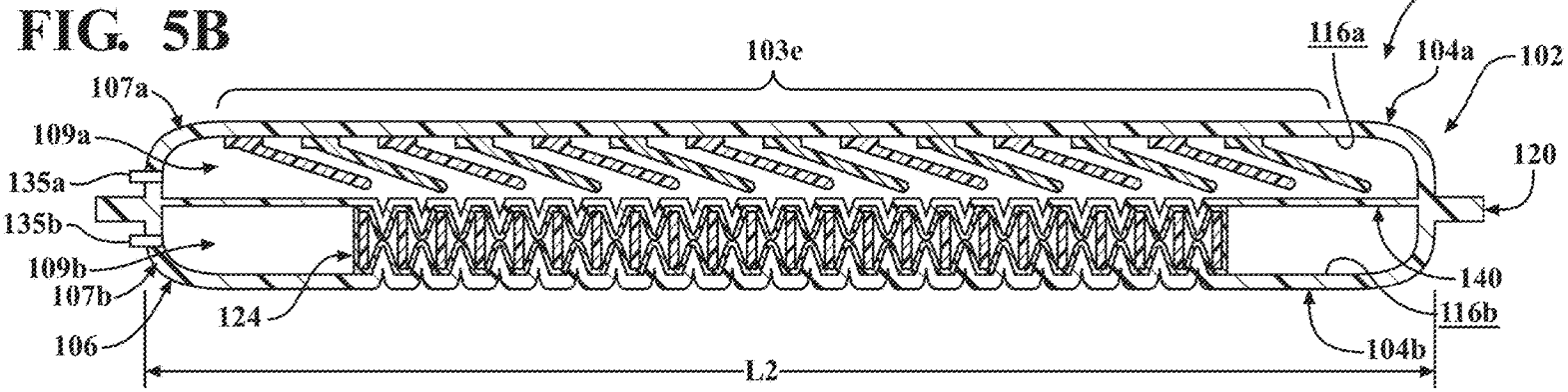
FIG. 5B is an example of the locking structure of FIG. 5A in a constricted state.

With particular reference to FIGS. 5A and 5B, a locking structure 100*e* is provided and includes the bladder 102 and a locking system 103*e* disposed within the bladder 102. In view of the substantial similarity in structure and function of the components associated with the locking structure 100*a* with respect to the locking structure 100*e*, like reference numerals are used hereinafter and in the drawings to identify like components while like reference numerals containing letter extensions are used to identify those components that have been modified.

Figure 5C:
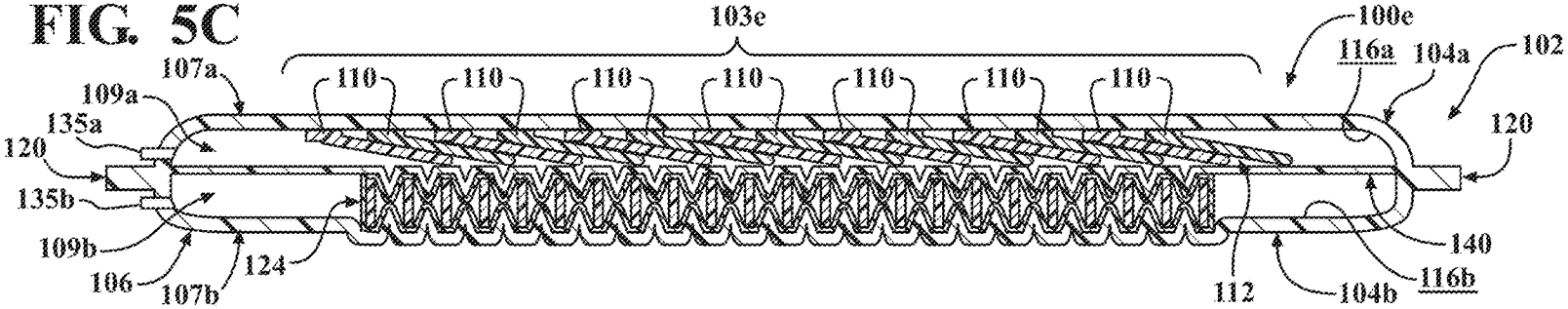
FIG. 5C is an example of the locking structure of FIG. 5B in a locked state.

Referring to FIGS. 5A-5C, in some implementations, the locking structure 100*e* includes a plurality of the locking elements 110*a* and the compressible component 124 disposed within the interior void 108 of the chamber 106. In these implementations, the chamber 106 may include an inner barrier layer 140 disposed within the interior void 108 between the first barrier layer 104*a* and the second barrier layer 104*b*. The inner barrier layer 140 separates the chamber 106 into a first subchamber 107*a* including a first interior void 109*a* which receives the plurality of locking elements 110*a*, and a second subchamber 107*b* including a second interior void 109*b* which receives the compressible component 124. The first subchamber 107*a* includes a first port 135*a* in fluid communication with the first interior void 109*a*, and the second subchamber 107*b* includes a second port 135*b* in fluid communication with the second interior void 109*b*. In use, the locking structure 100*e* is moved from a relaxed state to a constricted state by adjusting the fluid pressure within the second interior void 109*b*, and from the unlocked state to the locked state by adjusting the fluid pressure within the first interior void 109*a*. For example, the pressures within the interior voids 109*a*, 109*b* of the subchambers 107*a*, 107*b* may be reduced by drawing a respective vacuum within the interior voids 109*a*, 109*b* through the ports 135*a*, 135*b* attached to the bladder 102. In these examples, the pressure within the first interior void 109*a* may be reduced by drawing a vacuum within the first interior void 109*a* through the port 135*a* attached to the bladder 102, while the pressure within the second interior void 109*b* may be reduced by drawing a vacuum within the second interior void 109*b* through the port 135*b* attached to the bladder 102. In some examples, the first interior void 109*a*, and the second interior void 109*b* maintain the same pressure (i.e., at or above ambient). In other examples, one of the first interior void 109*a* and the second interior void 109*b* may maintain a different pressure than the other of the first interior void 109*a* and the second interior void 109*b*.

While in a relaxed state (FIG. 5A), the plurality of locking elements 110*a* are disposed within the first interior void 109*a* on the first inner surface 116*a* of the first barrier layer 104*a* and are arranged in a spaced apart manner to prevent direct contact between the interface surfaces 122 of the plurality of locking elements 110*a*, while the compressible component 124 is disposed within the second interior void 108*b*. The compressible component 124 may be attached to the inner barrier layer 140 so that the compressible component 124 pulls both the second inner surface 116*b* and the inner barrier layer 140 when the compressible component 124 transitions from the relaxed state to the constricted state. In this relaxed state, the locking structure 100*e* is relatively flexible and can conform to a variety of geometries.

When the pressure of the second interior void 108*b* of the chamber 106 is reduced from a first pressure (e.g., ambient) to a second pressure (e.g., below ambient), the compressible component 124 constricts and pulls the attached second barrier layer 104*b* and inner barrier layer 140 to move the locking structure 100*e* from the relaxed state to the constricted state (FIG. 5B). In the illustrated example, the transition from the relaxed state to the constricted state is represented by a change in the overall length of the bladder 102 from a first length L1 in the relaxed state to a smaller second length L2 in the constricted state.

When the pressure of the first interior void 109*a* of the chamber 106 is reduced from a third pressure (e.g., ambient) to a fourth pressure (i.e., a pressure below the first pressure), the first barrier layer 104*a* and the inner barrier layer 140 move toward one another to bring the plurality of locking elements 110*a* into direct contact with one another at the interface surfaces 122. Each locking element 110*a* in the plurality of locking elements 110*a* overlaps adjacent locking elements 110*a*, and once the plurality of locking elements 110*a* are in overlapping direct contact with one another at their respective interface surfaces 122, the resulting friction between the interface surfaces 122 forms the locking layer 112 that maintains the locking structure 100*e* in the constricted state to the locked state (FIG. 5C).

In some examples, the pressure may be reduced within the respective interior voids 109*a*, 109*b* in sequential stages. For example, the pressure may be reduced within the second interior void 109*b* in a first stage to transition the locking structure 100*e* from the relaxed state to the constricted state while the pressure within the first interior void 109*a* remains at the initial third pressure to maintain the locking system 103*e* in the unlocked state. Once the pressure reduction within the second interior void 109*b* is complete, the pressure within the first interior void 109*a* may be reduced in a second stage to transition the locking structure 100*e* to the locked state. In other examples, the pressures interior voids 109*a*, 109*b* may be simultaneously reduced such that the constriction and locking steps occur together.

Figures 6A, 6B, 6C:
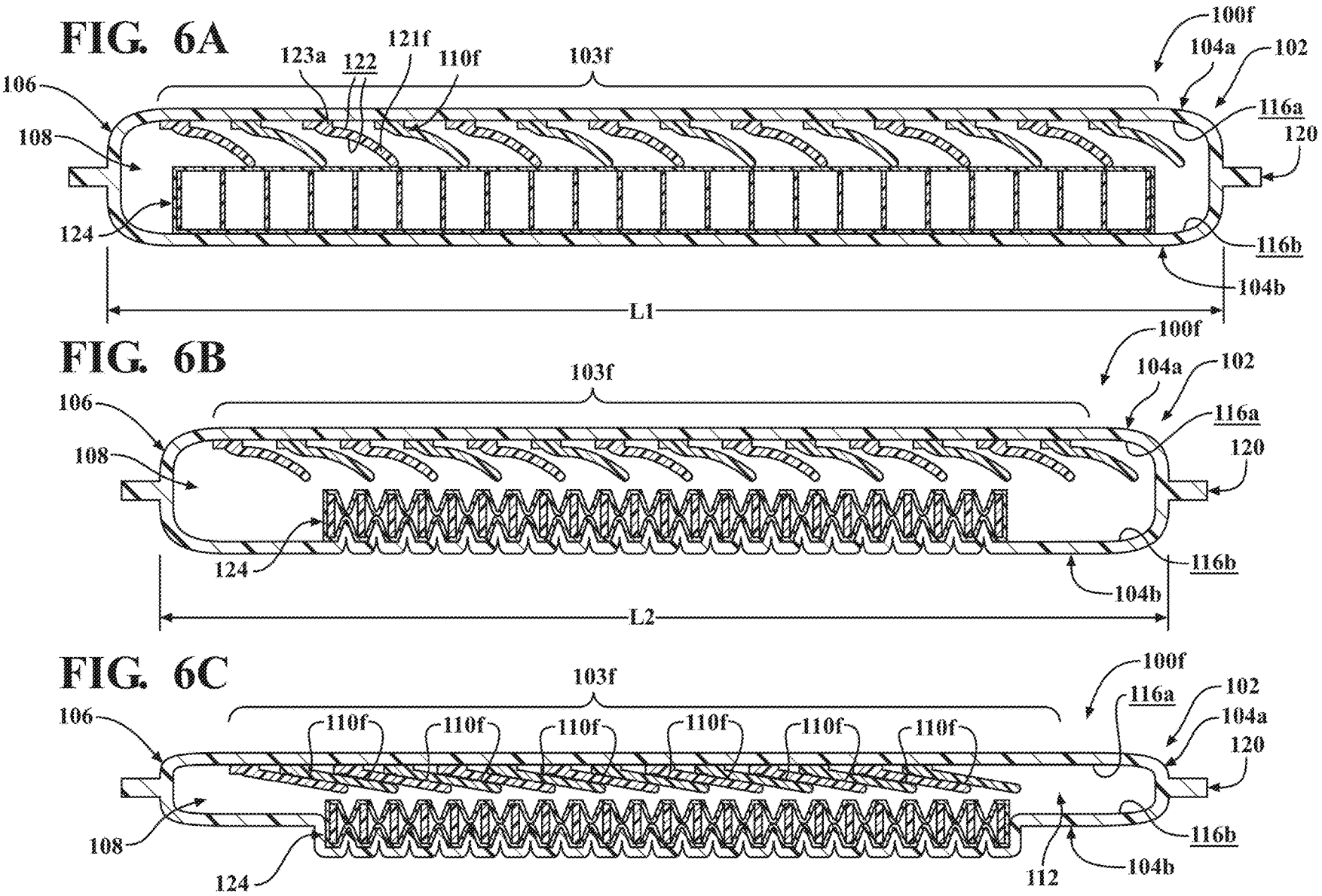
FIG. 6A is an example of a locking structure according to the present disclosure, where the locking structure is in a relaxed state.
FIG. 6B is an example of the locking structure of FIG. 6A in a constricted state.
FIG. 6C is an example of the locking structure of FIG. 6B in a locked state.

With particular reference to FIGS. 6A and 6B, a locking structure 100*f* is provided and includes the bladder 102 and a locking system 103*f* disposed within the bladder 102. In view of the substantial similarity in structure and function of the components associated with the locking structure 100*a* with respect to the locking structure 100*f*, like reference numerals are used hereinafter and in the drawings to identify like components while like reference numerals containing letter extensions are used to identify those components that have been modified.

Referring to FIGS. 6A-6C, in some implementations, locking structure 100*f* includes a plurality of the locking elements 110*a* and the compressible component 124 disposed within the interior void 108 of the chamber 106. In these implementations, the locking bodies 121*f* of plurality of locking elements 110*f* may be contoured to lift away from one another at ambient pressure. When pressure is applied to the plurality of contoured locking elements 110*f*, the locking bodies 121*f* plurality of contoured locking elements 110 are flattened and are brought into direct contact with one another at the interface surfaces 122 where each locking element 110*f* in the plurality of locking elements 110*f* overlaps adjacent locking elements 110*f*. Once the plurality of locking elements 110*f* are in overlapping direct contact with one another at their respective interface surfaces 122, the resulting friction between the interface surfaces 122 forms the locking layer 112 that transitions the locking structure 100*e* to the locked state.

While in a relaxed state (FIG. 6A), the plurality of locking elements 110*f* are disposed within the interior void 108 on the first inner surface 116*a* of the first barrier layer 104*a* and are arranged in a spaced apart manner to prevent direct contact between the interface surfaces 122 of the plurality of locking elements 110*f*. In this relaxed state, the locking structure 100*f* is relatively flexible and can conform to a variety of geometries. When the pressure of the interior void 108 of the chamber 106 is reduced from a first pressure (e.g., at or above ambient) to a second pressure (e.g., below ambient), the compressible component 124 constricts and pulls the attached second barrier layer 104*b* to move the locking structure 100*f* from the relaxed state to the constricted state (FIG. 6B). In the illustrated example, the transition from the relaxed state to the constricted state is represented by a change in the overall length of the bladder 102 from a first length L1 in the relaxed state to a smaller second length L2 in the constricted state.

When the pressure of the interior void 108 of the chamber 106 is reduced from the second pressure to a third pressure (i.e., a pressure below the second pressure), the plurality of locking elements 110*f* are transitioned from a contoured state to a flattened state, bringing the plurality of locking elements 110*f* into direct contact with one another at the interface surfaces 122 and with the constricted compressible component 124. Each locking element 110*f* in the plurality of locking elements 110*f* overlaps adjacent locking elements 110*f*, and once the plurality of locking elements 110*f* are flattened in overlapping direct contact with one another at their respective interface surfaces 122, the resulting friction between the interface surfaces 122 forms the locking layer 112 that transitions the locking structure 100*f* from the constricted state to the locked state (FIG. 6C).

When the pressure within the interior void 108 is increased from the third pressure to the second pressure, the resiliency of the locking elements 110*f* biases the interfaces 122 apart from each other to transition the locking system 103*f* from the locked state to the unlocked state. Thus, the locking elements 110*f* transition from the flattened or compressed state to their natural curved shape when the locking system 103*f* returns to the unlocked state.

With particular reference to FIGS. 7A-7F, a locking structure 100*g* is provided and includes the bladder 102 and a locking system 103*g* disposed within the bladder 102. In view of the substantial similarity in structure and function of the components associated with the locking structure 100*a* with respect to the locking structure 100*g*, like reference numerals are used hereinafter and in the drawings to identify like components while like reference numerals containing letter extensions are used to identify those components that have been modified.

The bladder 102 of the locking structure 100*g* includes the first barrier layer 104*a* and the second barrier layer 104*b* joined together along the peripheral seam 120 to define the chamber 106 enclosing the interior void 108. As discussed above, each of the barrier layers 104*a*, 104*b* defines an inner surface 116*a*, 116*b* and a respective outer surface 118*a*, 118*b* on the opposite side of the barrier layer 104*a*, 104*b* than the inner surface 116*a*, 116*b*.

Figure 7A:
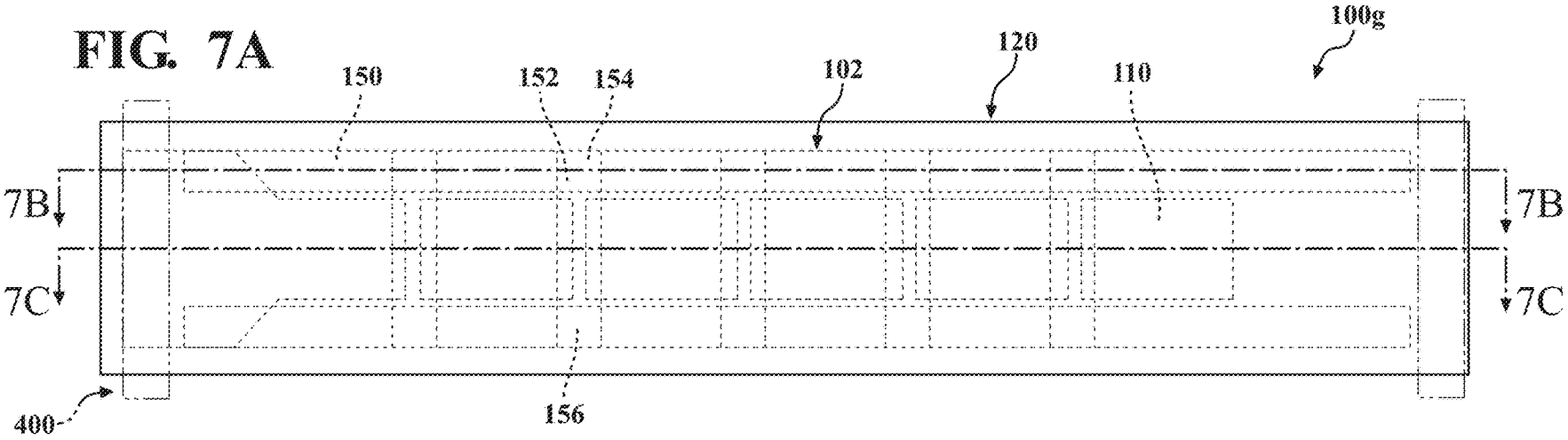
FIG. 7A is a plan view of an example of a locking structure according to the present disclosure, where the locking structure is in an unlocked state.

FIG. 7A shows a plan view of an example of the locking structure 100*g* including the bladder 102 and the locking system 103*g* disposed within the bladder 102. As shown, the bladder 102 may be anchored to a substrate (e.g., an upper of a shoe, fabric of a garment) at one or more anchor locations along the substrate 400. In FIG. 7A, the locking structure 100*g* is shown in a contracted, unlocked state where the locking system 100*g* has a first length L1. As detailed in FIGS. 7B and 7C, the locking structure 100*g* includes the locking system 103*g* having a plurality of the locking elements 110 disposed on each of the inner surfaces 116*a*, 116*b* of the barrier layers 104*a*, 104*b* for selectively securing the locking structure 100*g* in a locked state (FIGS. 7D-7F). The locking structure 100*g* further includes one or more biasing elements 150 extending along the length of the locking structure 100*g* and configured to bias the locking structure 100*g* towards the contracted first length L1. In FIG. 7A, the biasing elements 150 include a pair of the biasing elements 150 extending in parallel along opposite sides of the locking system 103*g*, such that the locking elements 110 are arranged in series between the two biasing elements 150.

The locking system 103*g* further includes a plurality of cross members 152 each extending from a first end 154 attached to a first one of biasing elements 150 on a first side of the bladder 102 to a second end 156 attached to a second one of the biasing elements 150 on a second side of the bladder 102. Thus, unlike the locking elements 110, which are disposed between the biasing elements 150 and move independently of the biasing elements 150 along the length of the locking structure 100*g*, the ends 154, 156 of the cross members 152 are attached to the biasing elements 150 such that the cross members 152 move in relation to the state of the biasing elements 150, as discussed below.

Figure 7B:
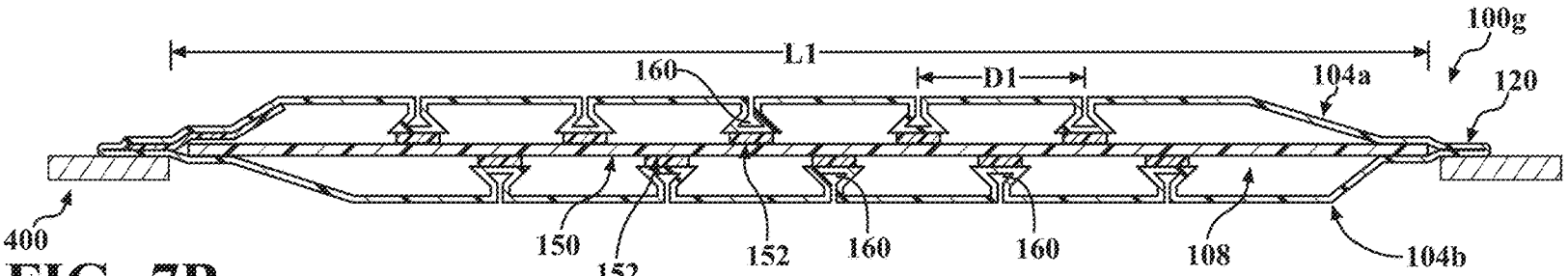
FIG. 7B is a cross-sectional view of the locking structure of FIG. 7A, taken along Line 76-76 of FIG. 7A.

Referring to FIG. 7B, a first cross-sectional view of the locking structure 100*g* is taken along Line 7B-7B in FIG. 7A and shows an interface between a first one of the biasing elements 150 and the first ends 154 of each of the cross members 152. It should be understood that the interface between the other one of the biasing elements 150 and the second ends 156 of each of the cross members 152 is substantially similar to the interface between the biasing element 150 and the first ends 154 of the cross members 152. As shown, a first side of each end 154, 156 of each cross member 152 is attached to the biasing element 150 and an opposite second side of each end 154, 156 of each respective cross member 152 is attached to one of the inner surfaces 116*a*, 116*a* of the barrier layers 104*a*, 104*b*. Thus, the cross members 152 each provide a series of attachment interfaces between the biasing elements 150 and the respective barrier layers 104*a*, 104*b*. In the contracted state, the biasing elements 150 cause the bladder 102 to contract to the first length L1 such that the spacing between adjacent ones of the cross members 152 is defined by a first distance D1. Here, the first length L1 of the biasing element 150 is less than the second length L2 of the barrier layers 104*a*, 104*b* (FIGS. 7D-7F), such that the biasing elements 150 cause each of the barrier layers 104*a*, 104*b* to bunch or collect along the length L1 when the locking structure 100*g* is in the contracted state. More particularly, the excess lengths of the material of the barrier layers 104*a*, 104*b* collect along folds 160 formed at each of the cross members 152.

Figure 7C:
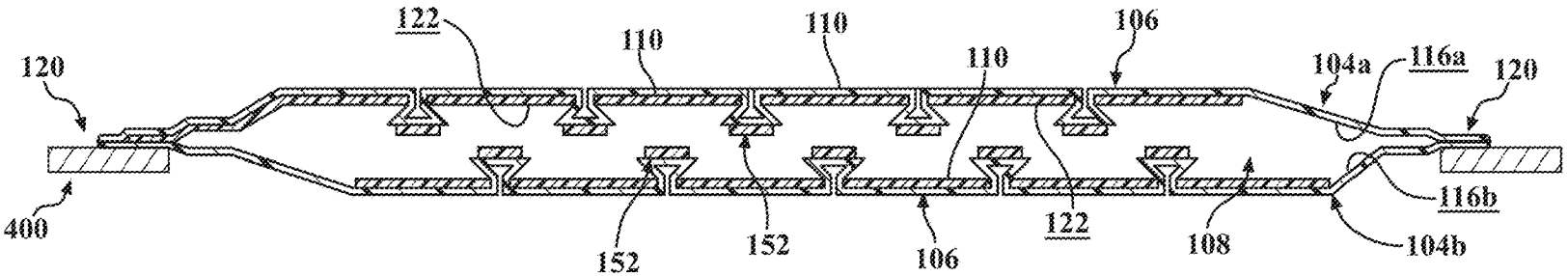
FIG. 7C is a cross-sectional view of the locking structure of FIG. 7A, taken along Line 7C-7C of FIG. 7A.
Figure 7D:
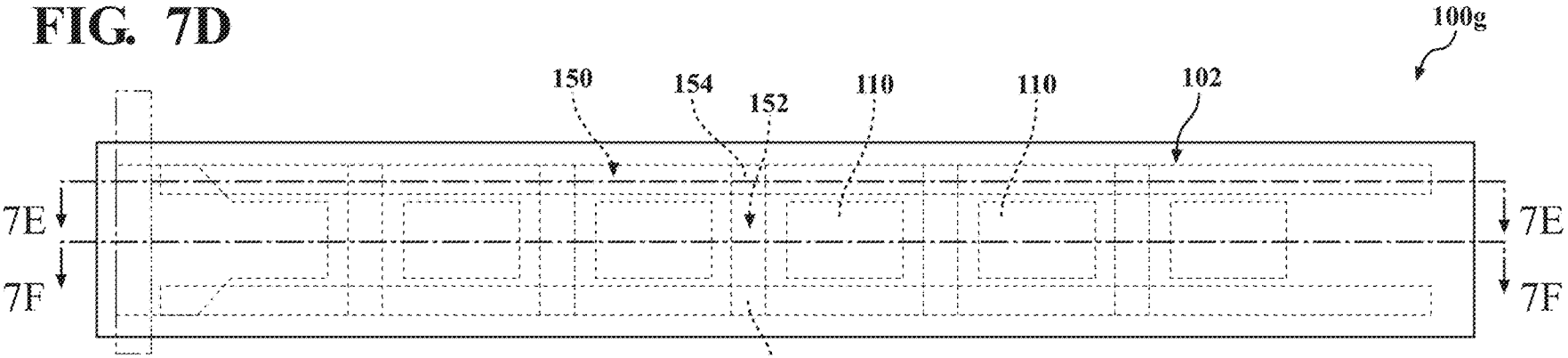
FIG. 7D is a plan view of the locking structure of FIG. 7A, where the locking structure is in a locked state.
Figure 7E:
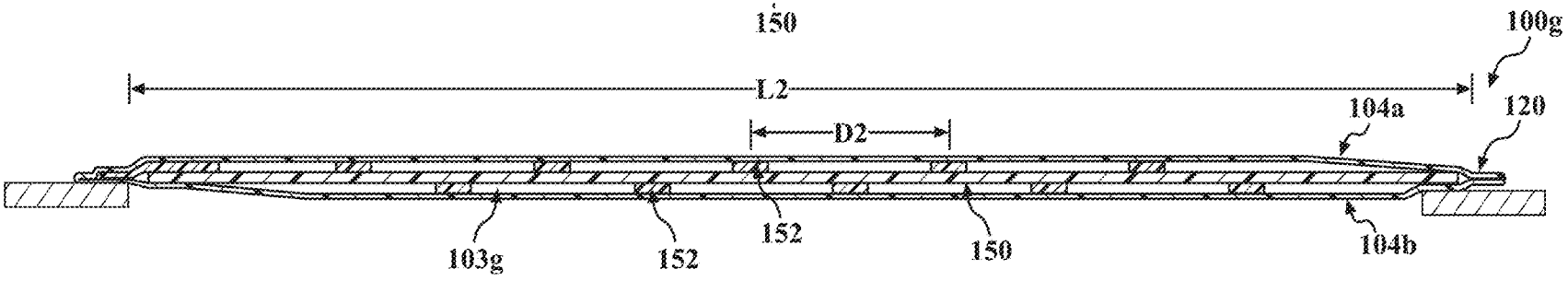
FIG. 7E is a cross-sectional view of the locking structure of FIG. 7A, taken along Line 7E-7E of FIG. 7A.
Figure 7F:
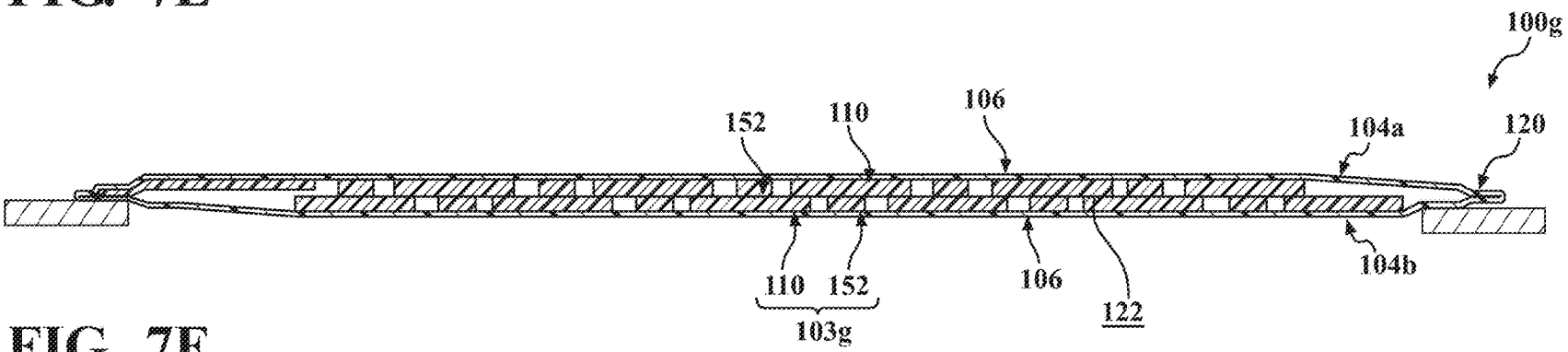
FIG. 7F is a cross-sectional view of the locking structure of FIG. 7A, taken along Line 7F-7F of FIG. 7A.

Referring to FIG. 7C, a second cross-sectional view of the locking structure 100*g* is taken along Line 7C-7C in FIG. 7A, which extends substantially along a central longitudinal axis of the locking structure 100*g*. As discussed above, the locking structure 100*g* includes a plurality of the locking elements 110 disposed on the inner surfaces 116*a*, 116*b* of each of the barrier layers 104*a*, 104*b*. Here, the locking elements 110 are arranged in an alternating series with the cross members 152 (e.g., locking element-cross member-locking element) along each inner surface 116*a*, 116*b*. In the illustrated example, the locking elements 110 and cross members 152 arranged along the first inner surface 116*a* are longitudinally offset (i.e., along the length L1 of the locking structure 100*g*) from the locking elements 110 and cross members 152 arranged along the second inner surface 116*b*. Thus, centers of the locking elements 110 attached to the first inner surface 116*a* are aligned across the locking structure 100*g* from centers of the cross members 152 of the second inner surface 116*b*, and vice versa. In other examples, the locking elements 110 and cross members 152 may be offset by different amounts or may not be offset (i.e., cross members are aligned with cross members and locking elements are aligned with locking elements).

With reference to FIGS. 7D-7F, the locking structure 100*g* is shown in an extended and locked state. In the extended state, the locking structure 100*g* has a second length L2 that is greater than the first length L1. Additionally, the spacing between adjacent ones of the locking members 152 transitions from the first distance D1 to a greater second distance D2. Thus, whereas the cross members 152 are overlapped by adjacent ones of the locking elements 110 at the folds 160 when the locking structure 100*g* is in the contracted state (FIG. 7C), the cross members 152 are disposed between adjacent ones of the locking elements 110 along the length of the locking structure 100*g* when the locking structure 100*g* is in the extended state.

In use, the locking structure 100*g* is transitioned between the contracted, unlocked state (FIGS. 7A-7C) and the extended, locked state (FIGS. 7D-7F) to selectively unlock and lock the locking structure 100*g*, thereby allowing the substrate 400 to be secured around a respective body part of the wearer. As discussed previously, FIGS. 7A-7C represent the locking structure 100*g* in the unlocked state, where a user can insert a body part within the wearable article (e.g., a shoe upper) and the locking structure 100*g* can freely move from the contracted state to the extended state, or an intermediate state between the contracted state and the extended state, to accommodate the body part. When the locking structure 100*g* is in the extended state, pressure within the interior void 108 of the chamber 106 may be reduced (e.g., a vacuum) to draw the opposing inner surfaces 116*a*, 116*b* of the barrier layers 104*a*, 104*b* towards each other. As the barrier layers 104*a*, 104*b* are drawn towards each other, the locking elements 110 and cross members 152 attached to the first barrier layer 104*a* engage the locking elements 110 and/or cross members 152 on the opposite barrier layer 104*b*. As discussed previously, each of the locking elements 110 include a locking interface 122 configured to cooperate with an interface surface 122 of an opposing locking element 110 to prevent relative translational movement between the locking elements 110. When a user desires to remove the wearable article including the locking structure 100*g*, the pressure within the interior void is increased (e.g., vacuum released) and the locking elements 110 move apart from each other allow the locking structure 100*g* to expand and contract. The biasing elements 150 cause the locking structure 100*g* to return to the contracted state.

With particular reference to FIGS. 8A-8F, a locking structure 100*h* is provided and includes the bladder 102 and a locking system 103*h* disposed within the bladder 102. In view of the substantial similarity in structure and function of the components associated with the locking structure 100*a* with respect to the locking structure 100*h*, like reference numerals are used hereinafter and in the drawings to identify like components while like reference numerals containing letter extensions are used to identify those components that have been modified.

In the example of the locking structure 100*h* of FIGS. 8A-8F, the biasing elements include a first biasing element 150*a* and a second biasing element 150*b* extending independently along the length of the bladder 102. Unlike the locking structure 100*g*, where the cross members 152 provide the interface between biasing element 150 and the barrier layers 104*a*, 104*b*, the biasing elements 150*a*, 150*b* of the current example are connected to the respective barrier layers 104*a*, 104*b* via the locking elements 110. For example, the locking structure 100*h* includes a first series of locking elements 110 each having a first side attached to the first barrier layer 104*a* at a respective anchor 123*h* and a second side attached to the first biasing element 150*a*. The locking structure 100*h* further includes a second series of locking elements 110 each having a first side attached to the second barrier layer 104*b* at a respective anchor 123*h* and a second side attached to the second biasing element 150*b*. Thus, the locking elements 110 of each series are disposed between one of the barrier layers 104*a*, 104*b* and a respective one of the biasing elements 150*a*, 150*b*. In the illustrated example, bunching or collection of the material of the barrier layers 104*a*, 104*b* is accomplished by bellows or bulges forming in the barrier layers 104*a*, 104*b* between the anchors 123*h* of the locking elements 110. Thus, as the locking structure 100*h* moves from the extended state to the contracted state, the barrier layers 104*a*, 104*b* will bulge or bunch between adjacent anchors 123*h*.

Figure 8A:
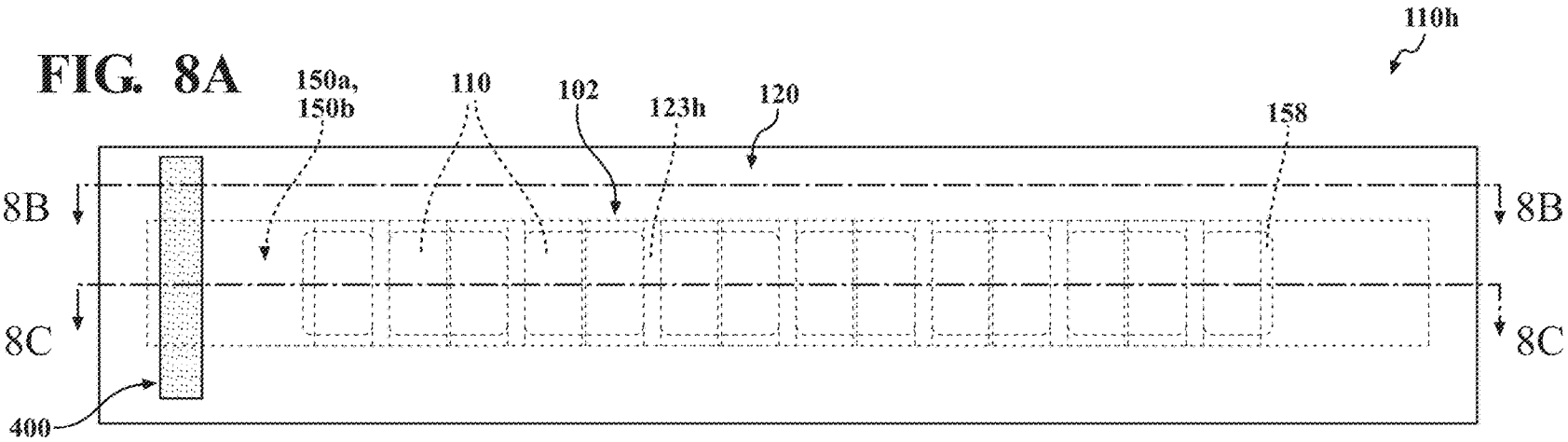
FIG. 8A is a plan view of an example of a locking structure according to the present disclosure, where the locking structure is in an unlocked state.
Figure 8B:
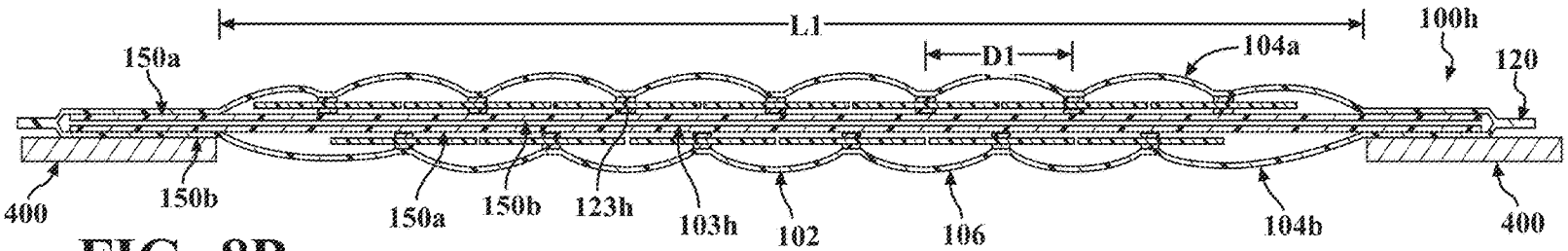
FIG. 8B is a cross-sectional view of the locking structure of FIG. 8A, taken along Line 8B-8B of FIG. 8A.
Figure 8C:
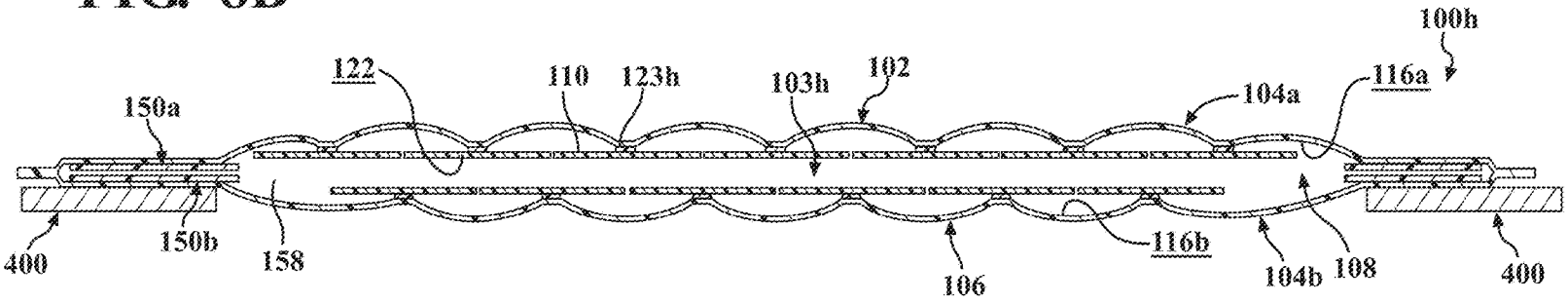
FIG. 8C is a cross-sectional view of the locking structure of FIG. 8A, taken along Line 8C-8C of FIG. 8A.
Figure 8D:
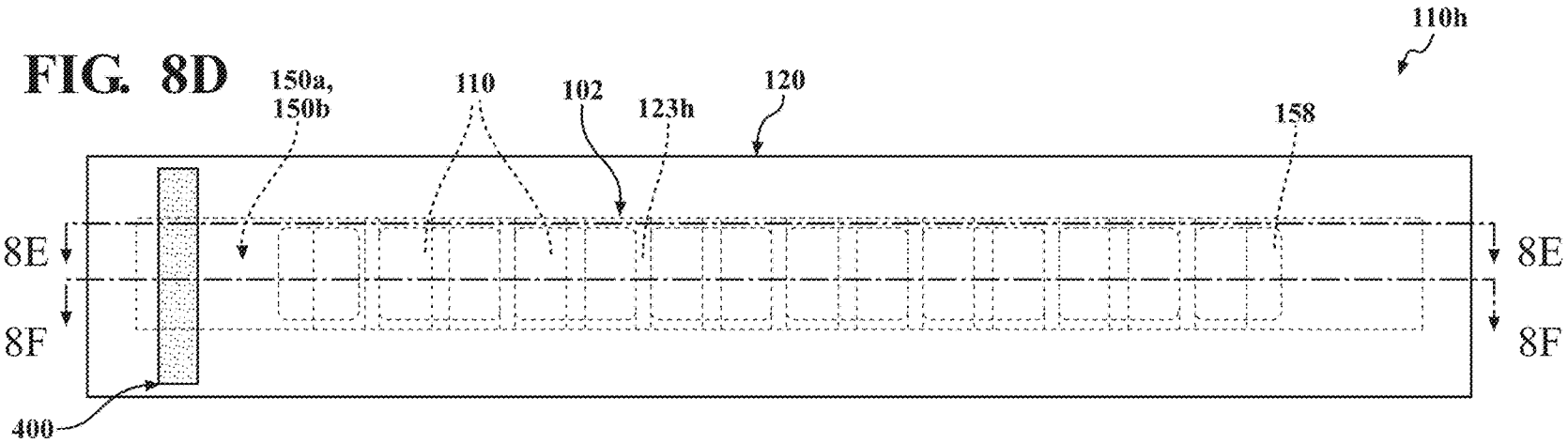
FIG. 8D is a plan view of the locking structure of FIG. 8A, where the locking structure is in a locked state.
Figure 8E:
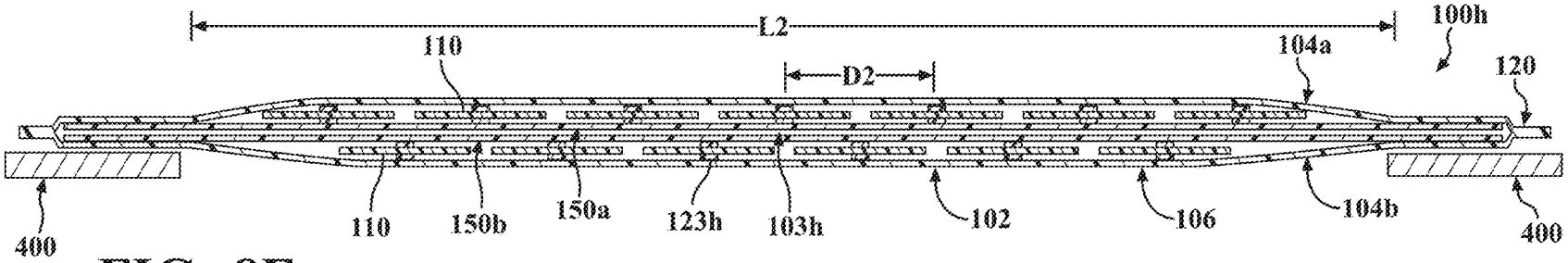
FIG. 8E is a cross-sectional view of the locking structure of FIG. 8A, taken along Line 8E-8E of FIG. 8A.
Figure 8F:
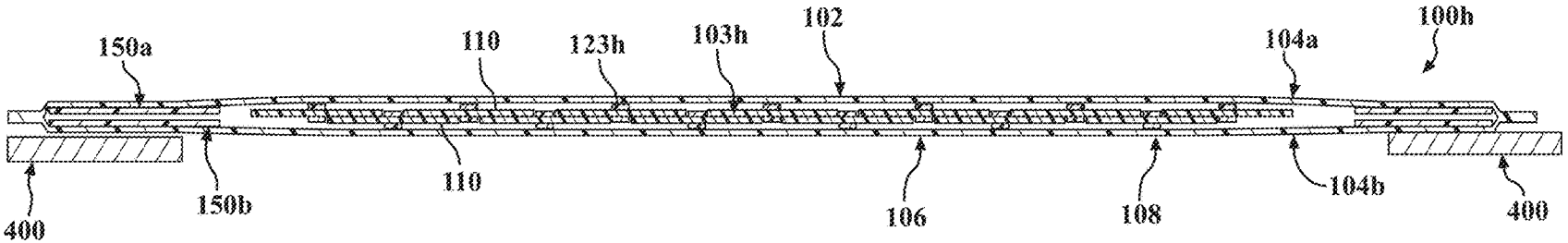
FIG. 8F is a cross-sectional view of the locking structure of FIG. 8A, taken along Line 8F-8F of FIG. 8A.
Figure 9A:
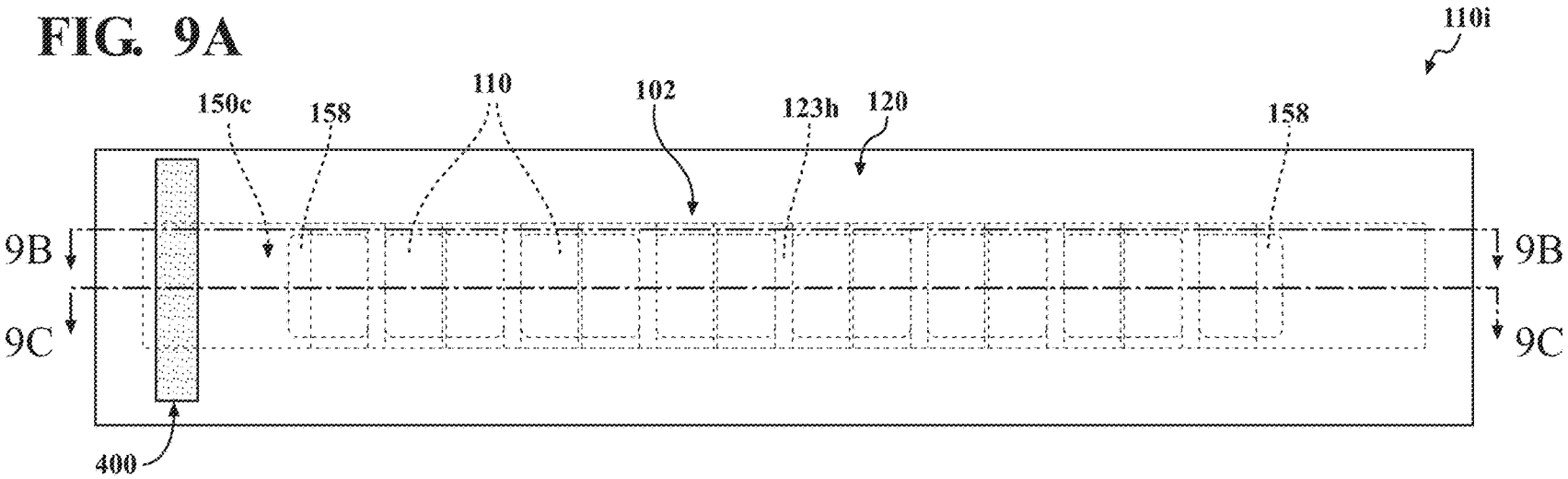
FIG. 9A is a plan view of an example of a locking structure according to the present disclosure, where the locking structure is in an unlocked state.
Figure 9B:
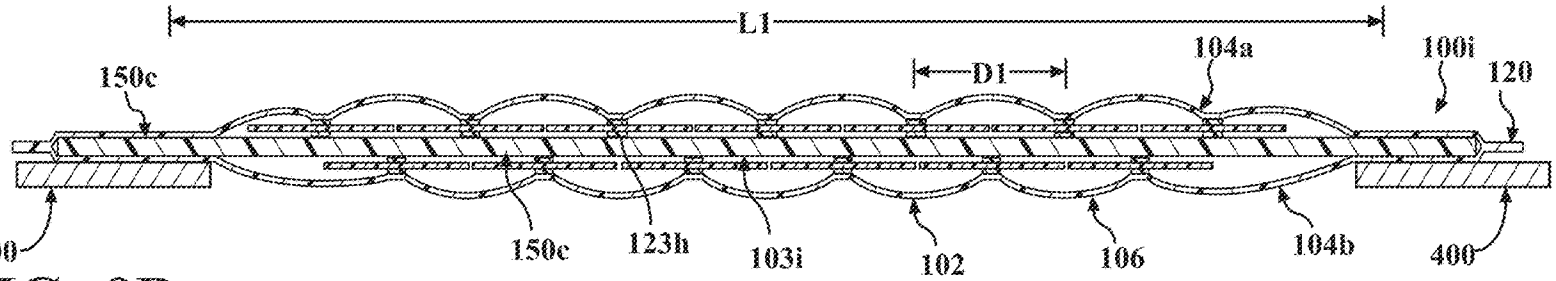
FIG. 9B is a cross-sectional view of the locking structure of FIG. 9A, taken along Line 9B-9B of FIG. 9A.
Figure 9C:
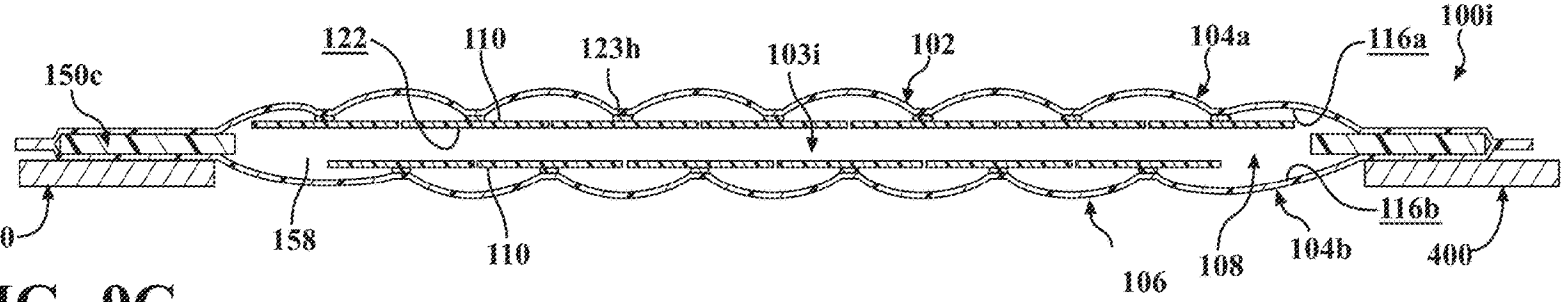
FIG. 9C is a cross-sectional view of the locking structure of FIG. 9A, taken along Line 9C-9C of FIG. 9A.
Figure 9D:
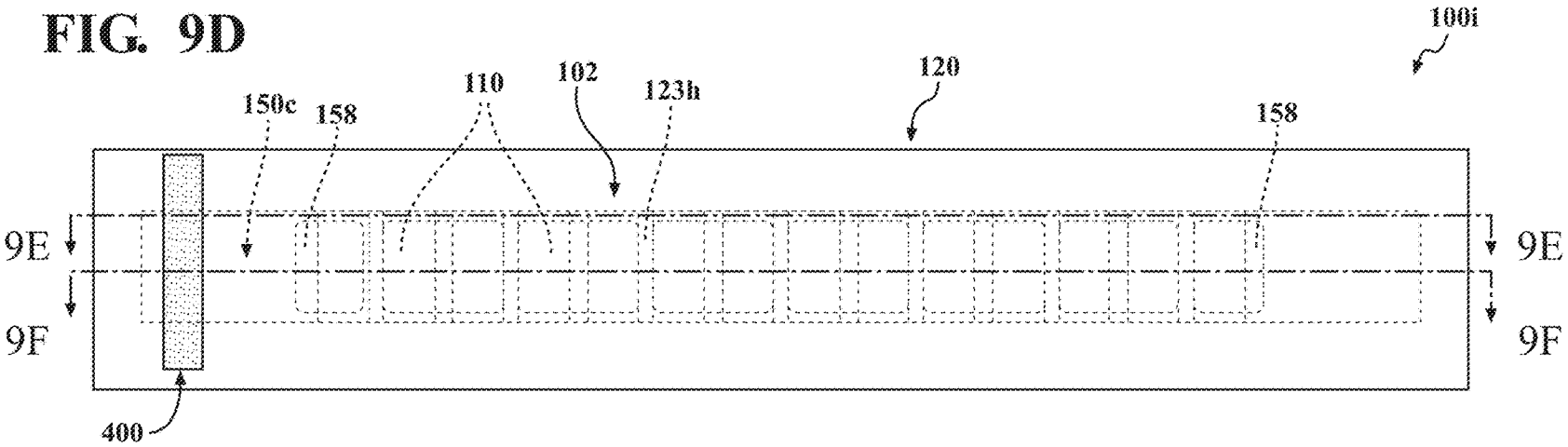
FIG. 9D is a plan view of the locking structure of FIG. 9A, where the locking structure is in a locked state.
Figure 9E:
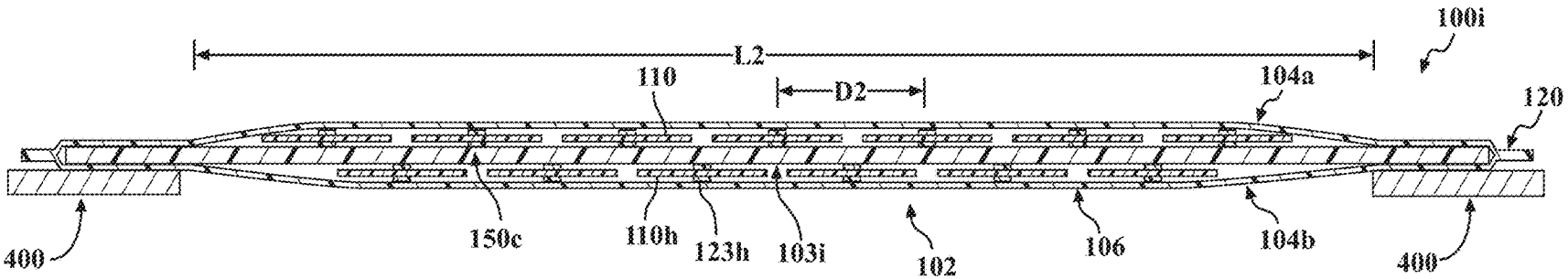
FIG. 9E is a cross-sectional view of the locking structure of FIG. 9A, taken along Line 9E-9E of FIG. 9A.
Figure 9F:
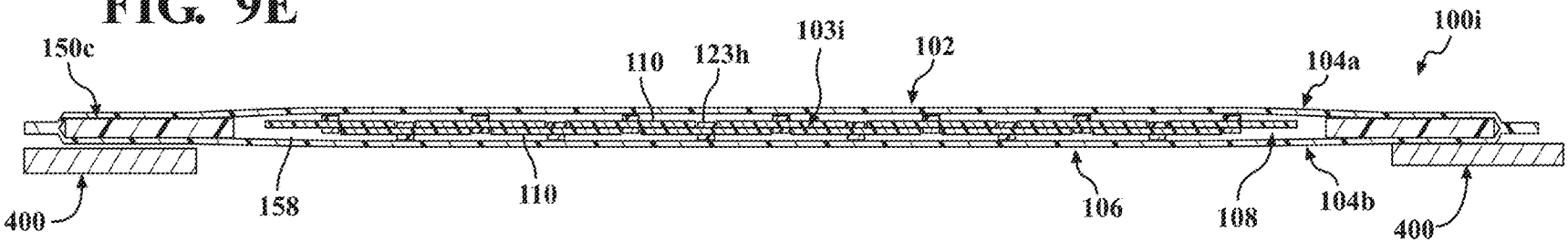
FIG. 9F is a cross-sectional view of the locking structure of FIG. 9A, taken along Line 9F-9F of FIG. 9A.
Figure 10A:
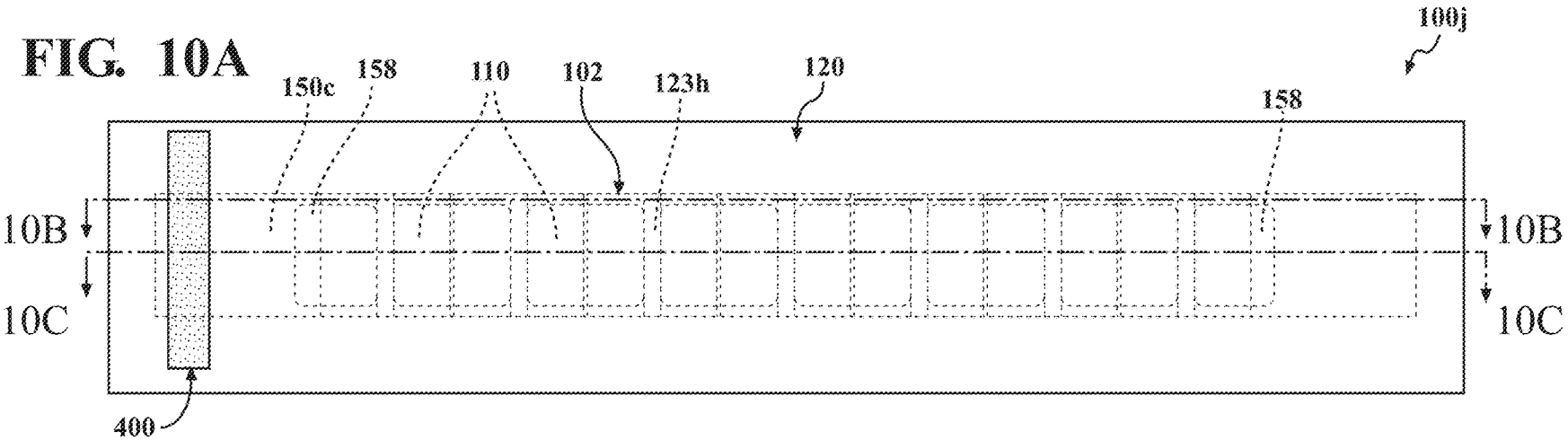
FIG. 10A is a plan view of an example of a locking structure according to the present disclosure, where the locking structure is in an unlocked state.
Figure 10B:
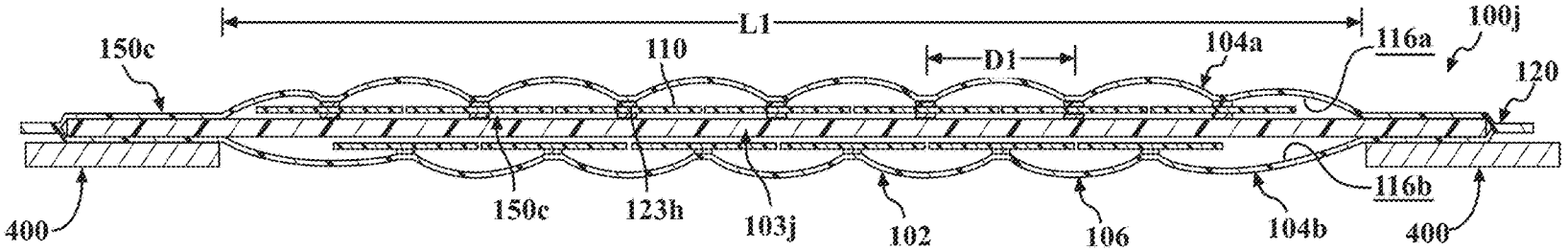
FIG. 10C is a cross-sectional view of the locking structure of FIG. 10A, taken along Line 10C-10C of FIG. 10A.
FIG. 10D is a plan view of the locking structure of FIG. 10A, where the locking structure is in a locked state.
FIG. 10E is a cross-sectional view of the locking structure of FIG. 10A, taken along Line 10E-10E of FIG. 10A.
FIG. 10F is a cross-sectional view of the locking structure of FIG. 10A, taken along Line 10F-10F of FIG. 10A.
Figure 10C:
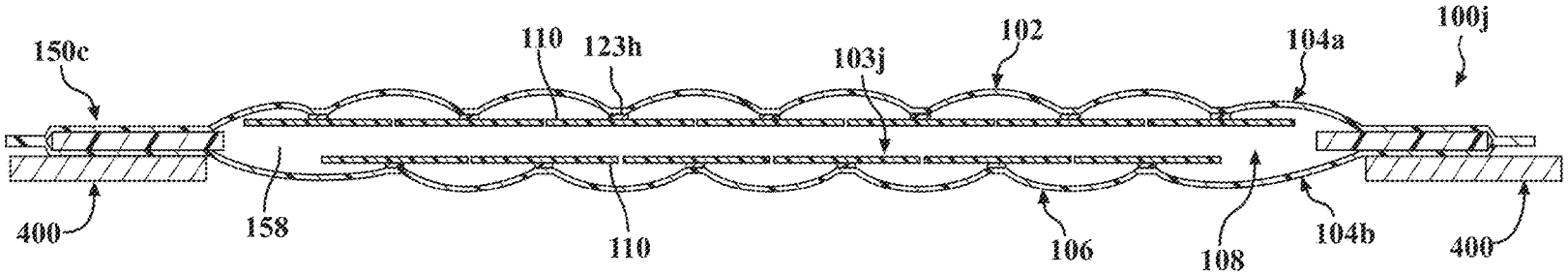
Figure 10D:
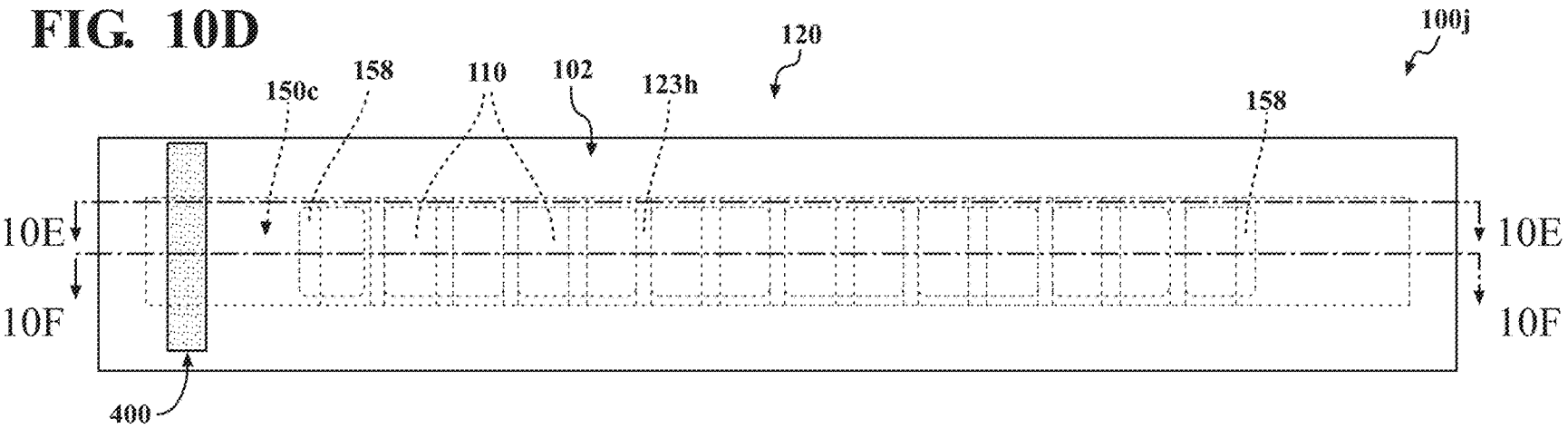
Figure 10E:
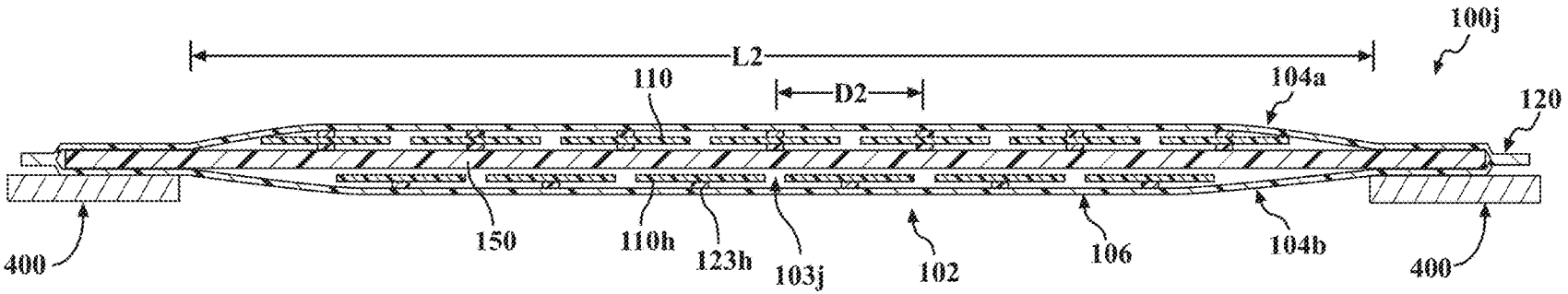
Figure 10F:
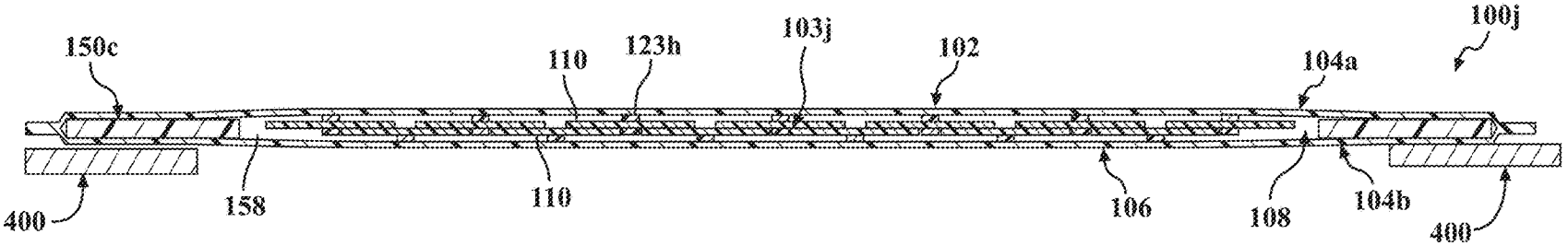
Figure 11A:
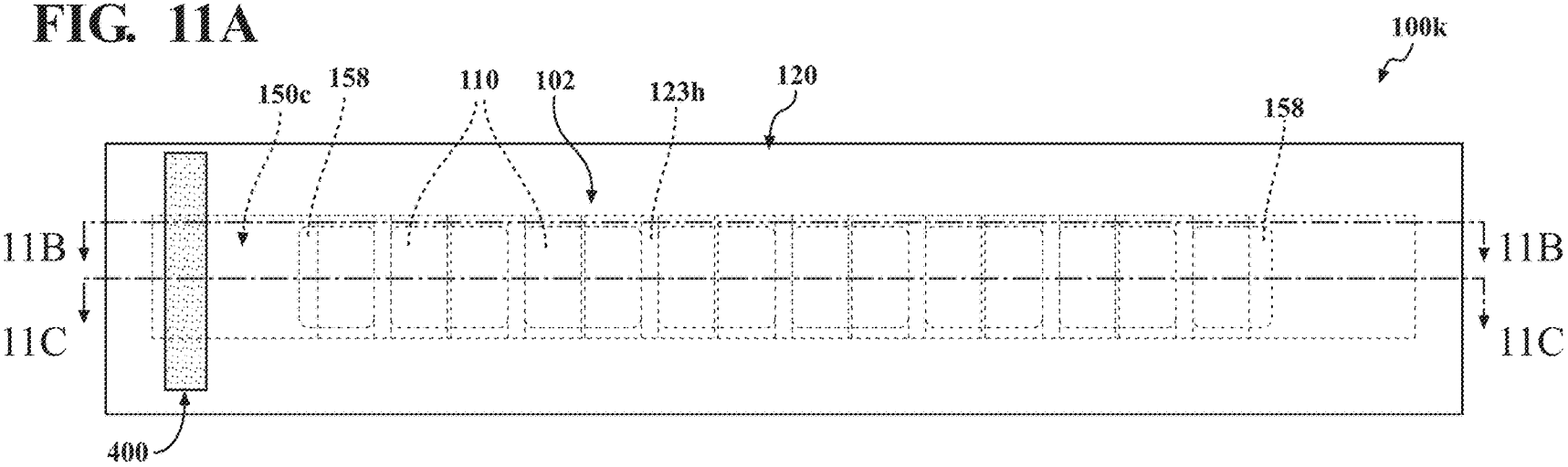
FIG. 11A is a plan view of an example of a locking structure according to the present disclosure, where the locking structure is in an unlocked state.
Figure 11B:
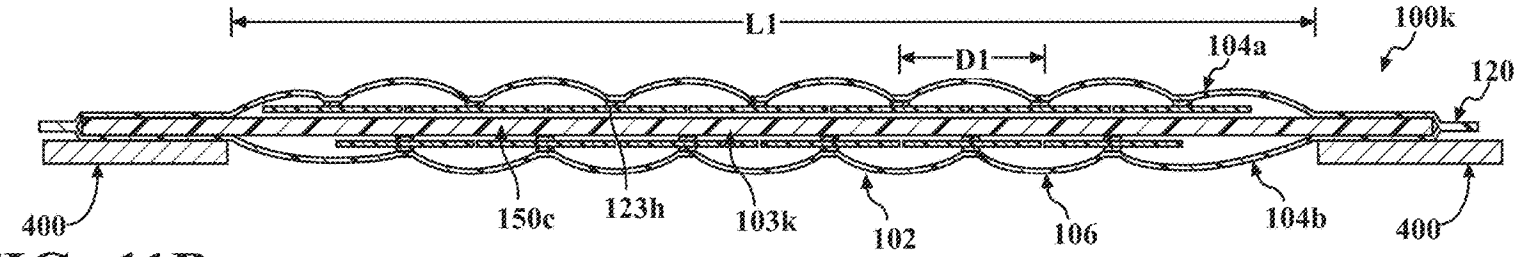
FIG. 11B is a cross-sectional view of the locking structure of FIG. 11A, taken along Line 116-116 of FIG. 11A.
Figure 11C:
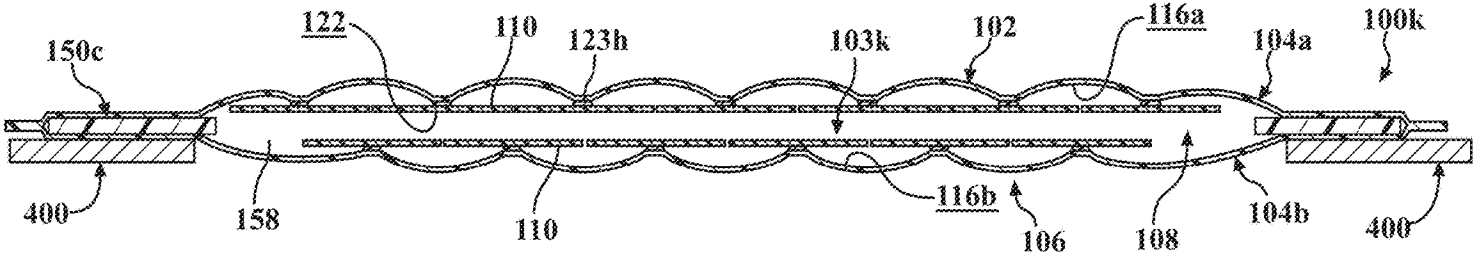
FIG. 11C is a cross-sectional view of the locking structure of FIG. 11A, taken along Line 11C-11C of FIG. 11A.
Figure 11D:
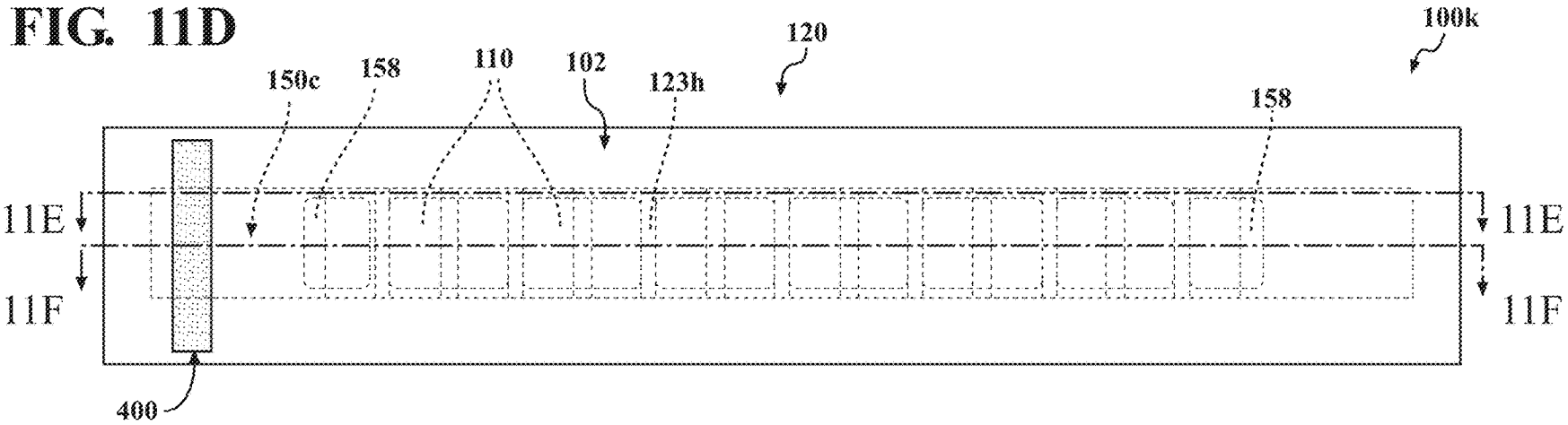
FIG. 11D is a plan view of the locking structure of FIG. 11A, where the locking structure is in a locked state.
Figure 11E:
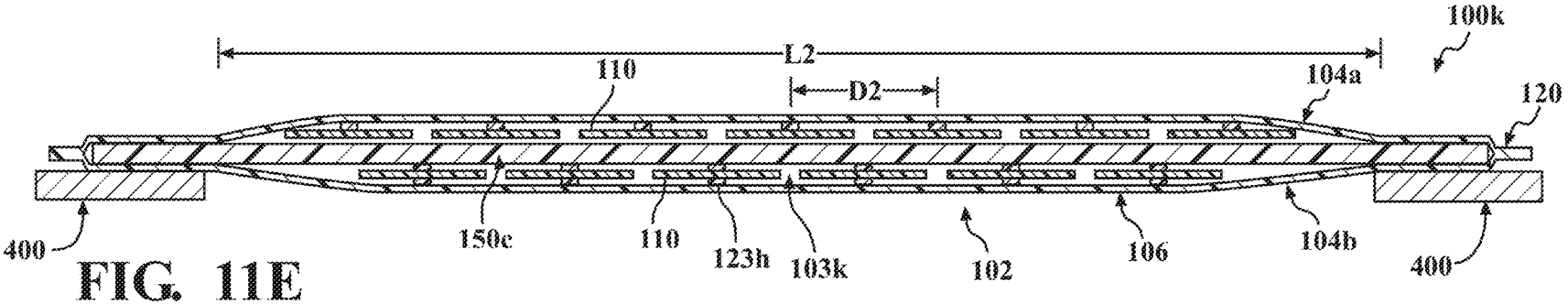
FIG. 11E is a cross-sectional view of the locking structure of FIG. 11A, taken along Line 11E-11E of FIG. 11A.
Figure 11F:
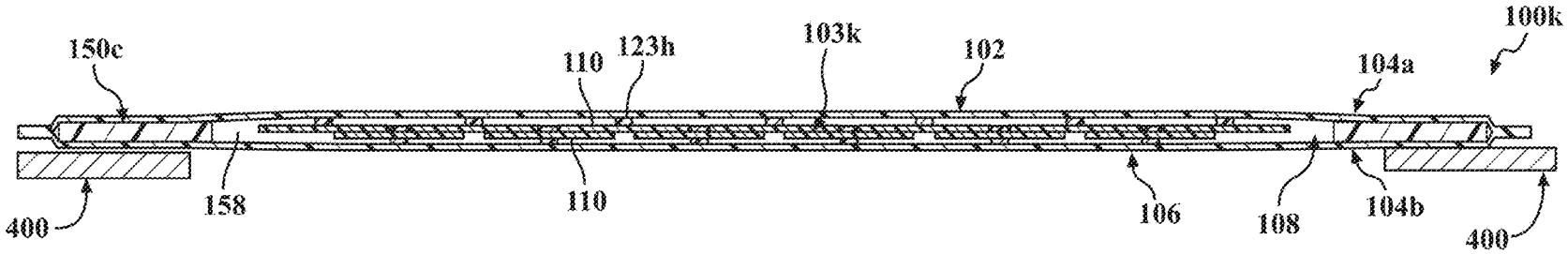
FIG. 11F is a cross-sectional view of the locking structure of FIG. 11A, taken along Line 11F-11F of FIG. 11A.
Figure 12A:
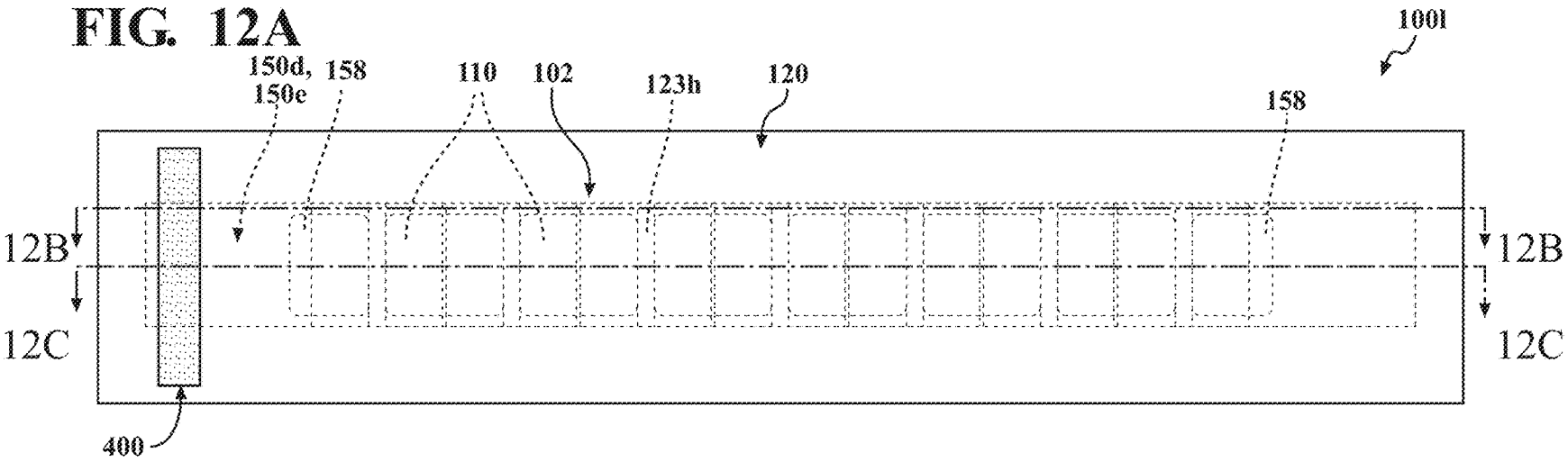
FIG. 12A is a plan view of an example of a locking structure according to the present disclosure, where the locking structure is in an unlocked state.
Figure 12B:
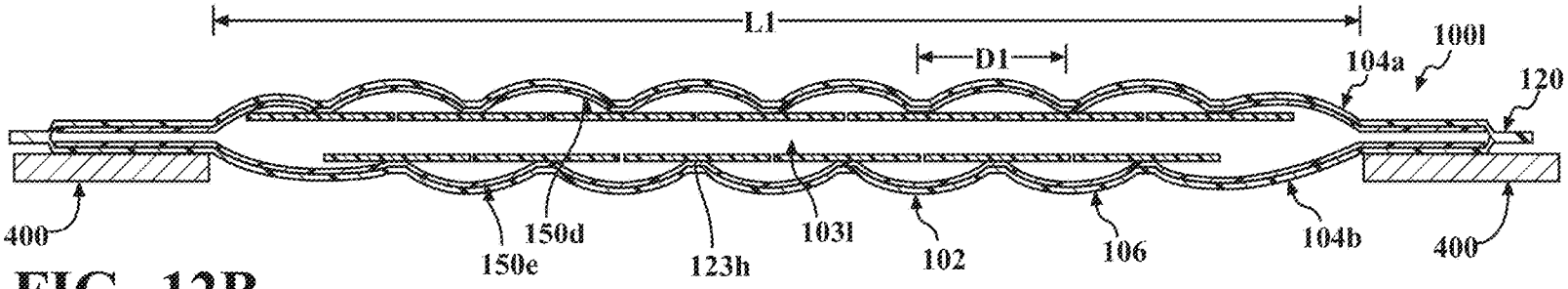
FIG. 12C is a cross-sectional view of the locking structure of FIG. 12A, taken along Line 12C-12C of FIG. 12A.
FIG. 12D is a plan view of the locking structure of FIG. 12A, where the locking structure is in a locked state.
FIG. 12E is a cross-sectional view of the locking structure of FIG. 12A, taken along Line 12E-12E of FIG. 12A.
FIG. 12F is a cross-sectional view of the locking structure of FIG. 12A, taken along Line 12F-12F of FIG. 12A.
Figure 12C:
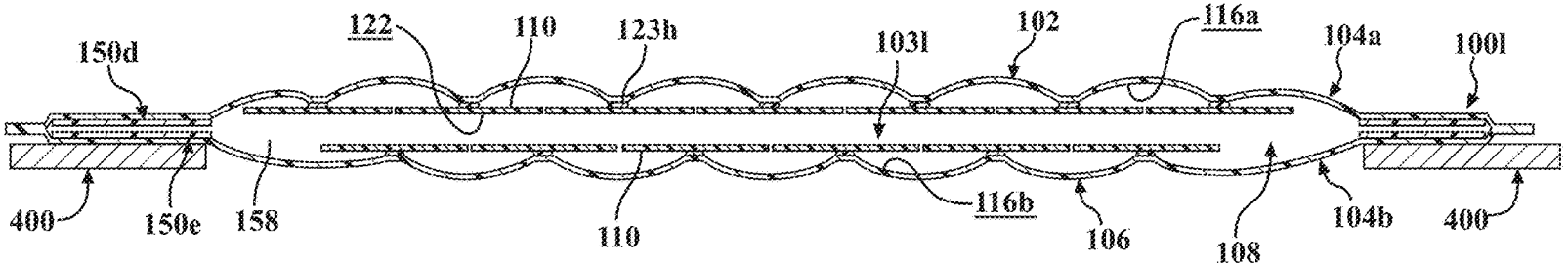
Figure 12D:
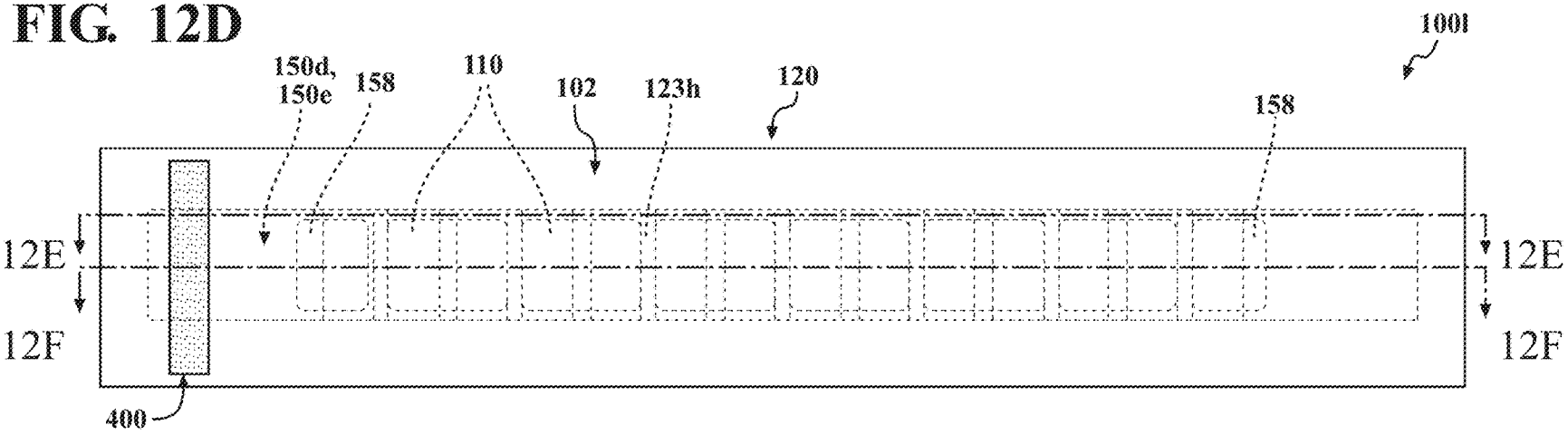
Figure 12E:
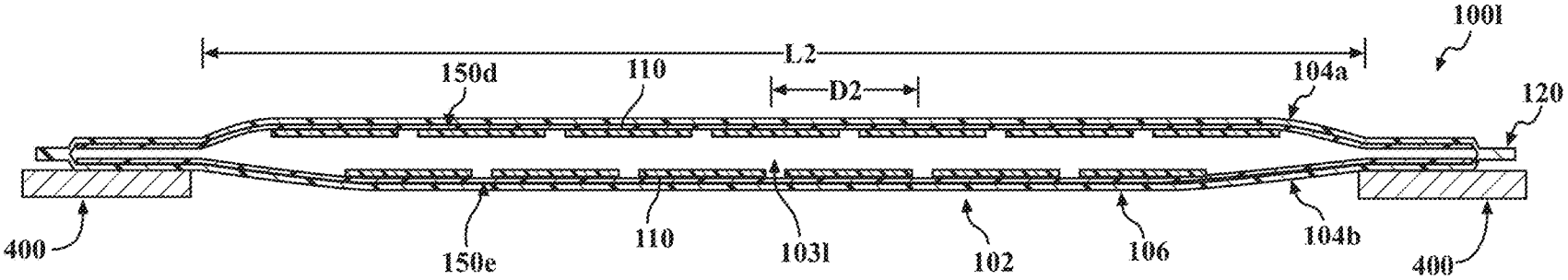
Figure 12F:
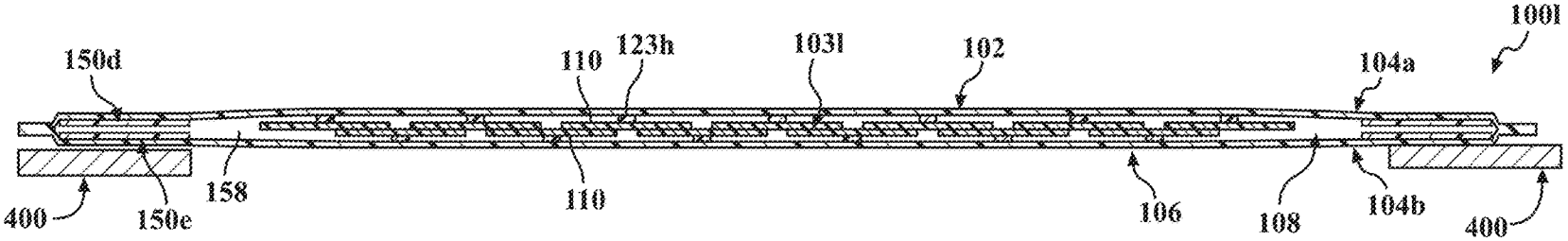
Figure 13A:
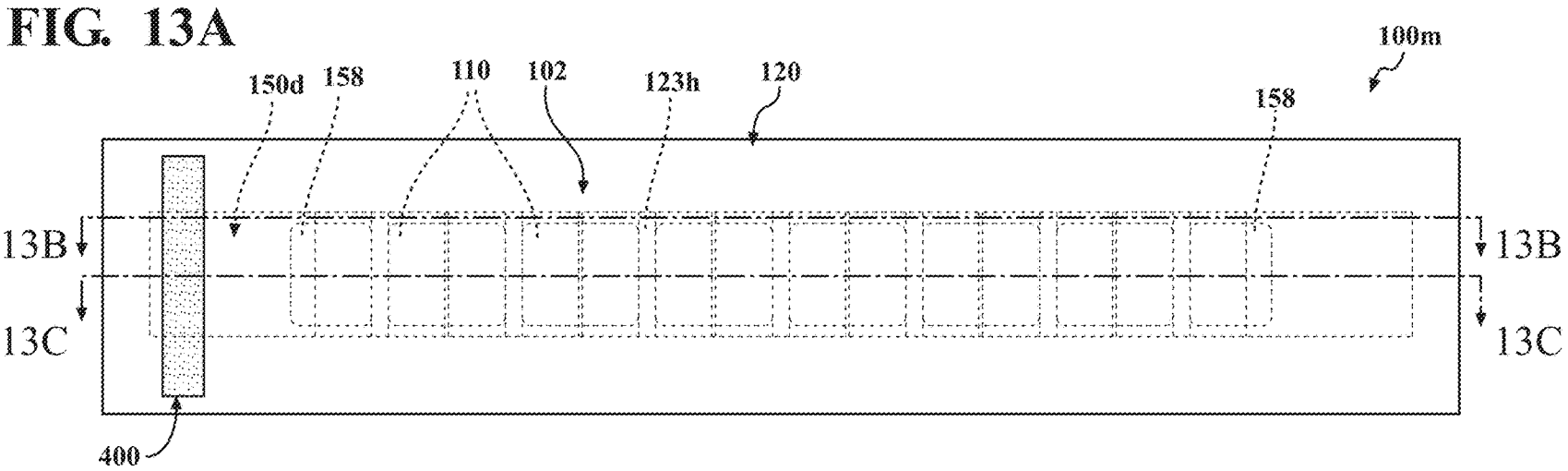
FIG. 13A is a plan view of an example of a locking structure according to the present disclosure, where the locking structure is in an unlocked state.
Figure 13B:
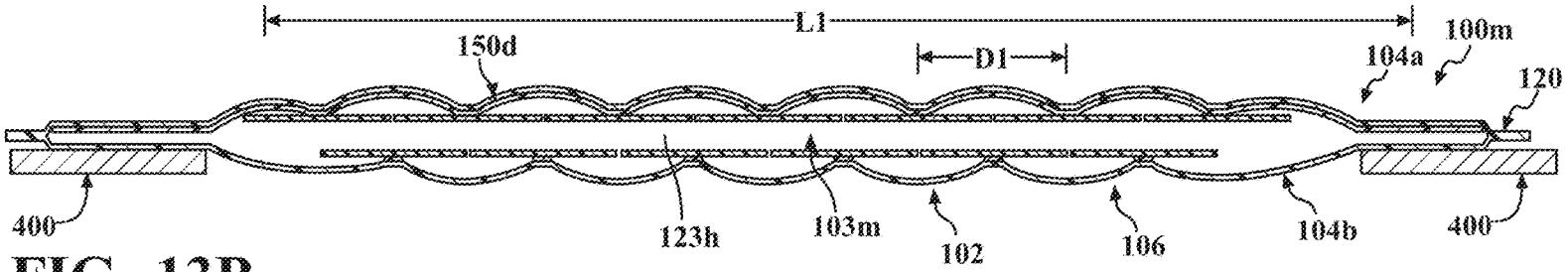
FIG. 13B is a cross-sectional view of the locking structure of FIG. 13A, taken along Line 13B-13B of FIG. 13A.
Figure 13C:
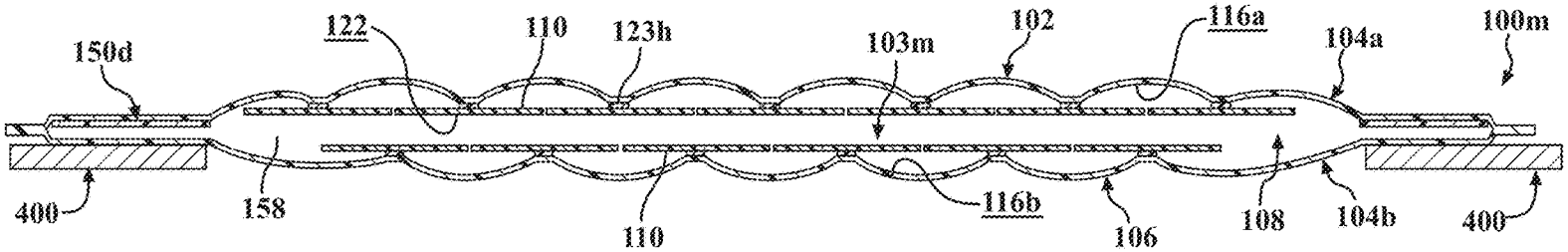
FIG. 13C is a cross-sectional view of the locking structure of FIG. 13A, taken along Line 13C-13C of FIG. 13A.
Figure 13D:
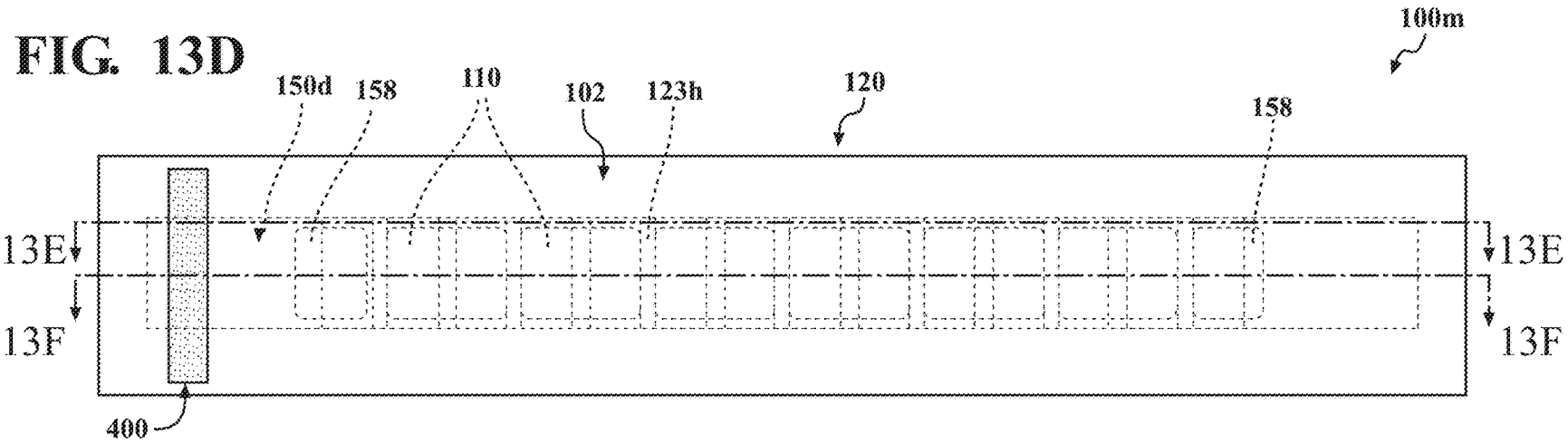
FIG. 13D is a plan view of the locking structure of FIG. 13A, where the locking structure is in a locked state.
Figure 13E:
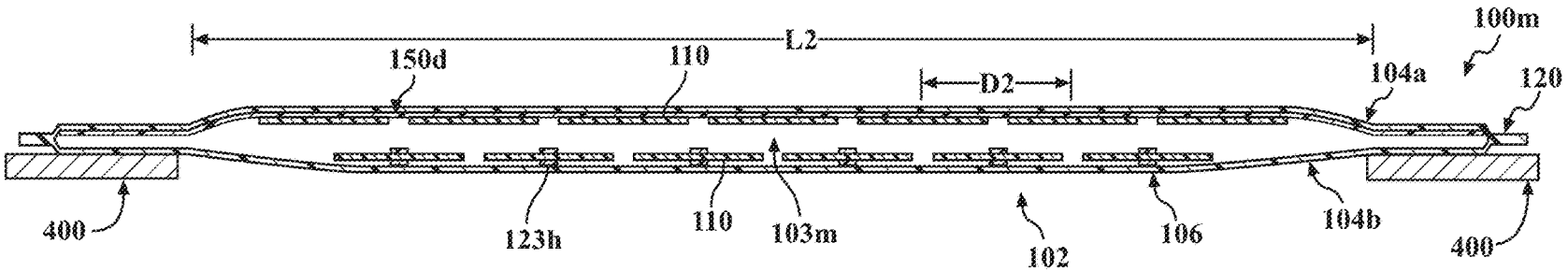
FIG. 13E is a cross-sectional view of the locking structure of FIG. 13A, taken along Line 13E-13E of FIG. 13A.
Figure 13F:
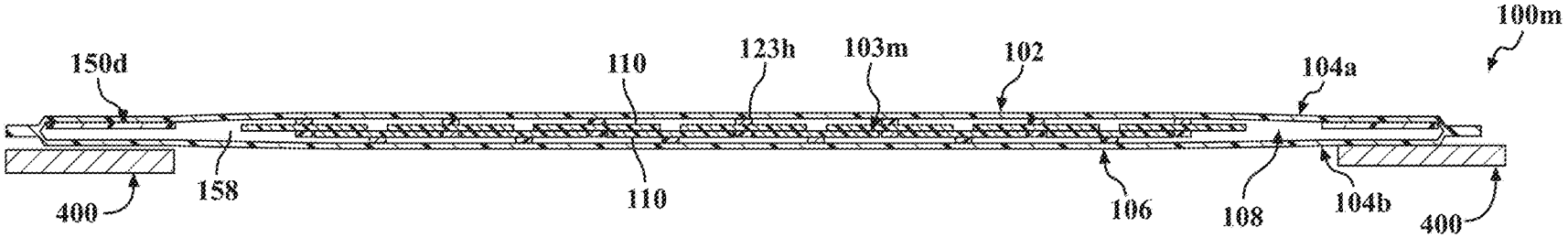
FIG. 13F is a cross-sectional view of the locking structure of FIG. 13A, taken along Line 13F-13F of FIG. 13A.
Figure 14A:
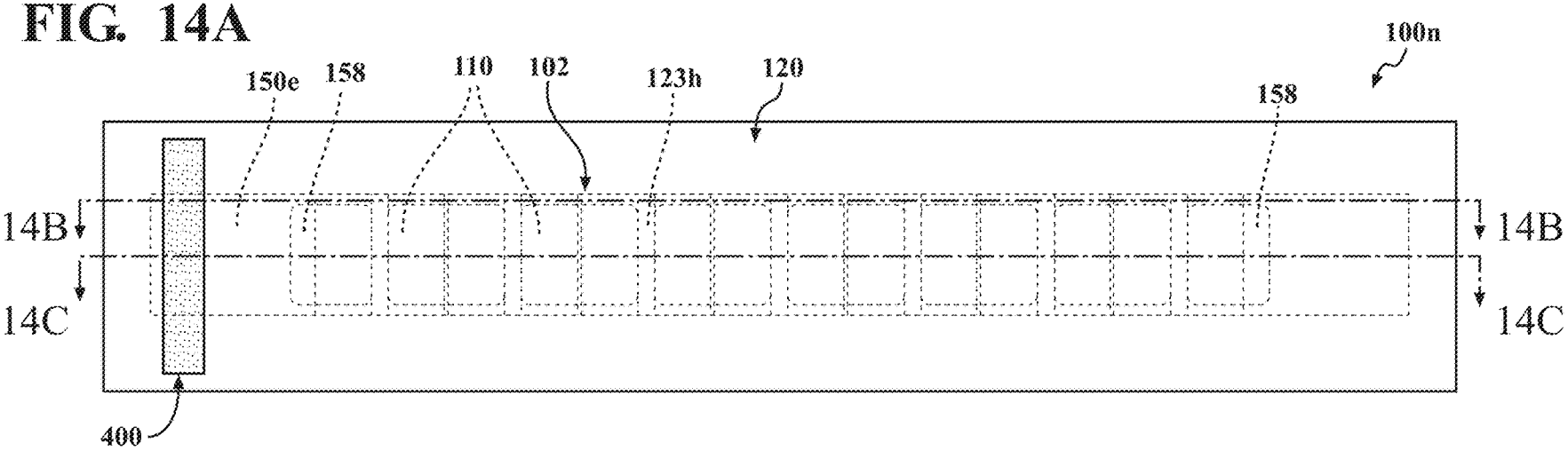
FIG. 14A is a plan view of an example of a locking structure according to the present disclosure, where the locking structure is in an unlocked state.
Figure 14B:
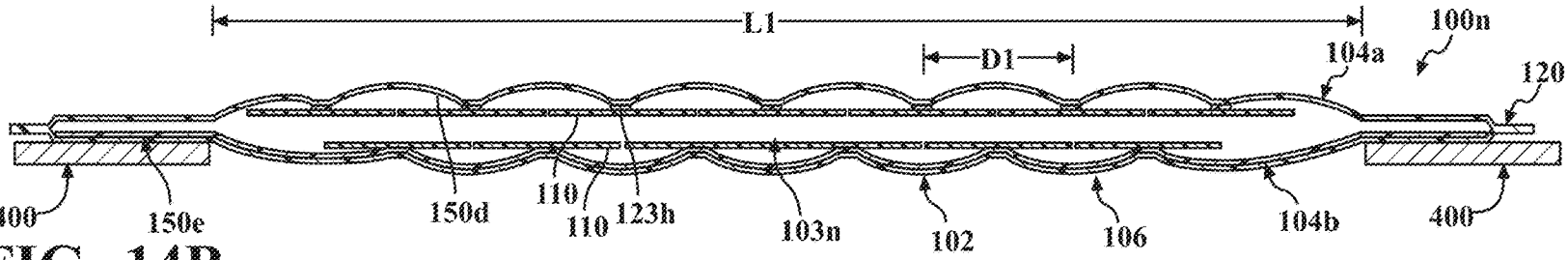
FIG. 14B is a cross-sectional view of the locking structure of FIG. 14A, taken along Line 14B-14B of FIG. 14A.
Figure 14C:
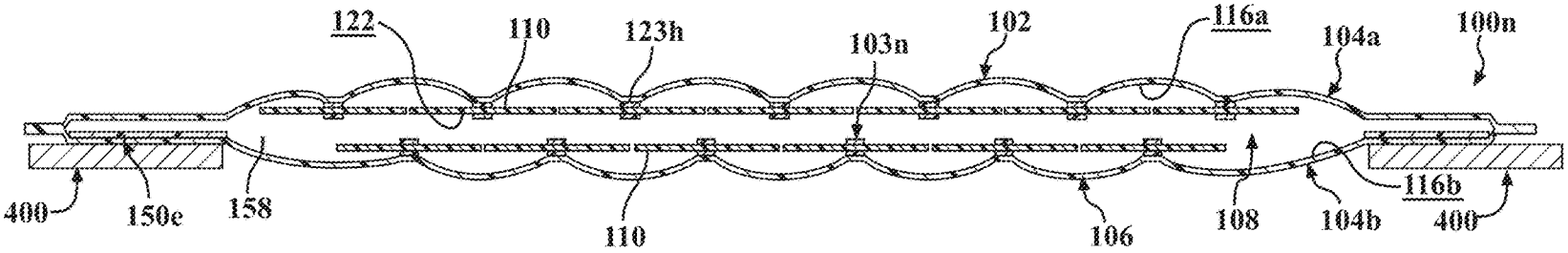
FIG. 14C is a cross-sectional view of the locking structure of FIG. 14A, taken along Line 14C-14C of FIG. 14A.
Figure 14D:
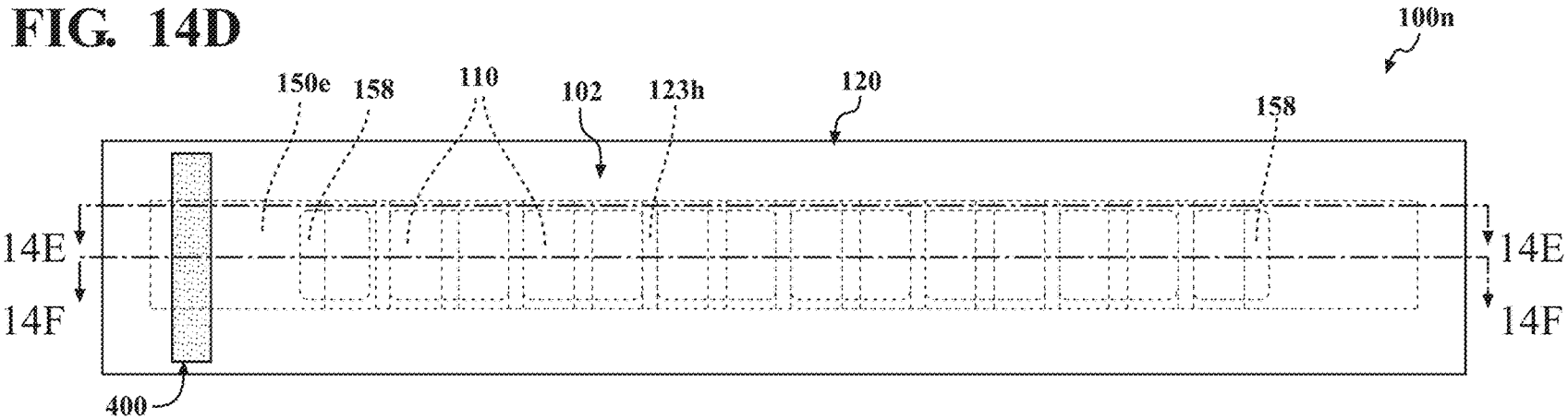
FIG. 14D is a plan view of the locking structure of FIG. 14A, where the locking structure is in a locked state.
Figure 14E:
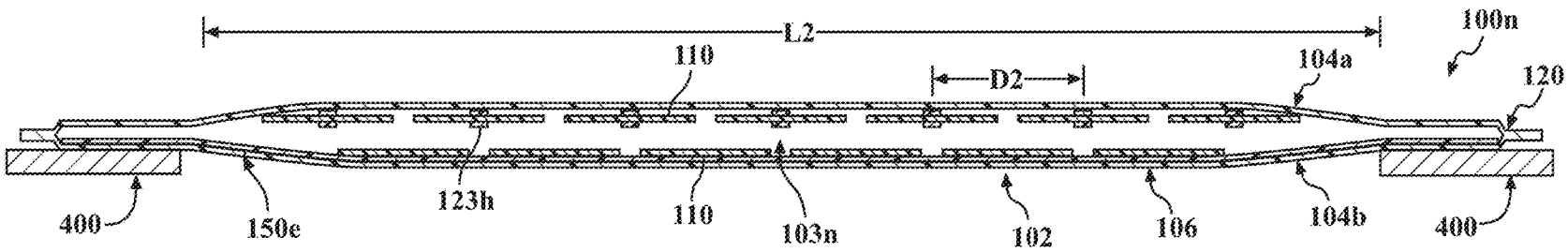
FIG. 14E is a cross-sectional view of the locking structure of FIG. 14A, taken along Line 14E-14E of FIG. 14A.
Figure 14F:
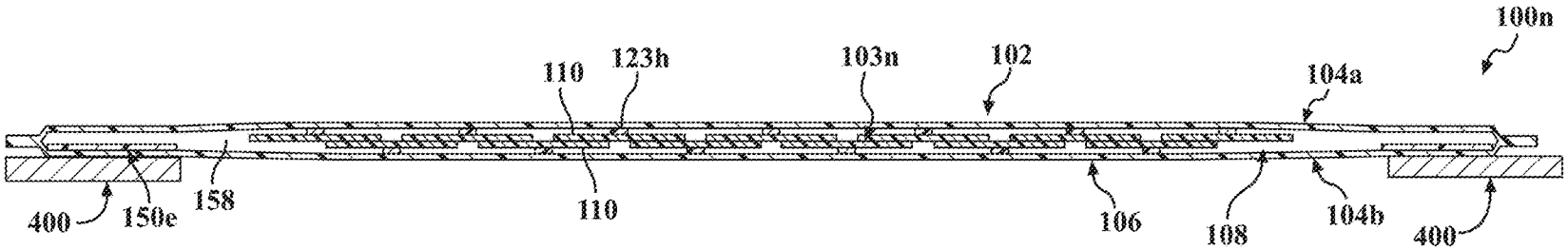
FIG. 14F is a cross-sectional view of the locking structure of FIG. 14A, taken along Line 14F-14F of FIG. 14A.

Each of the biasing elements 150*a*, 150*b* extends along the length of the locking structure 100*h* and includes a central opening 158 or cutout along which the locking elements 110 are arranged. As shown in FIG. 8A, each locking element 110 extends across a width of one of the biasing elements 150*a*, 150*b* and includes a first end attached to one of the biasing elements 150*a*, 150*b* on a first side of the opening 158 and a second end attached to the biasing element 150*a*, 150*b* on an opposite second side of the opening 158. Thus, an intermediate portion of each locking element 110 spans the opening 158 across the width of the biasing element 150*a*, 150*b*.

In use, the locking structure 100*h* transitions from the contracted, unlocked state (FIGS. 8A-8C) to the extended, locked state (FIGS. 8D-8F) in a similar manner as the locking structure 100*g*. When the locking structure 100*h* is in the unlocked state, a user can insert a body part within the wearable article (e.g., a shoe upper) and the locking structure 100*h* can freely move from the contracted state to the extended state, or an intermediate state between the contracted state and the extended state, to accommodate the body part. When the locking structure 100*h* is in the extended state, pressure within the interior void 108 of the chamber 106 may be reduced (e.g., a vacuum) to draw the opposing inner surfaces 116*a*, 116*b* of the barrier layers 104*a*, 104*b* towards each other. As the barrier layers 104*a*, 104*b* are drawn towards each other, the locking elements 110 attached to the first barrier layer 104*a* engage the locking elements 110 on the opposite barrier layer 104*b* through the openings 158 formed in the first and second biasing elements 150*a*, 150*b*. As discussed previously, each of the locking elements 110 include a locking interface 122 configured to cooperate with an interface surface 122 of an opposing locking element 110 through the openings 158 to prevent relative translational movement between the locking elements 110.

With particular reference to FIGS. 9A-9F, a locking structure 100*i* is provided and includes the bladder 102 and a locking system 103*i* disposed within the bladder 102. In view of the substantial similarity in structure and function of the components associated with the locking structure 100*a* with respect to the locking structure 100*i*, like reference numerals are used hereinafter and in the drawings to identify like components while like reference numerals containing letter extensions are used to identify those components that have been modified.

The example of the locking structure 100*i* provided in FIGS. 9A-9F is substantially similar to the locking structure 100*h* described previously, except that the independent biasing elements 150*a*, 150*b* are replaced with a single biasing element 150*c* including the opening 158. Here, the first series of the locking elements 110 are attached to the first barrier layer 104*a* and a first side of the biasing element 150*c* and a second series of the locking elements 110 are attached to the second barrier layer 104*b* and a second side of the biasing element 150*c*. Thus, unlike the locking structure 100*h*, where the locking elements 110 attached to the first barrier layer 104*a* and the first biasing element 150*a* can move between the extended and contracted states at a different rate than the locking elements 110 attached to the second barrier layer 104*b* and the second biasing element 150*b*, the first and second series of locking elements 110 of the locking structure 100*i* move between the contracted state and the extended state at the same rate, as both series of locking elements 110 are attached to the same biasing element 150*c*.

In use, the locking structure 100*i* transitions from the contracted, unlocked state (FIGS. 9A-9C) to the extended, locked state (FIGS. 9D-9F) in a similar manner as the locking structure 100*g*. When the locking structure 100*i* is in the unlocked state, a user can insert a body part within the wearable article (e.g., a shoe upper) and the locking structure 100*i* can freely move from the contracted state to the extended state, or an intermediate state between the contracted state and the extended state, to accommodate the body part. When the locking structure 100*i* is in the extended state, pressure within the interior void 108 of the chamber 106 may be reduced (e.g., a vacuum) to draw the opposing inner surfaces 116*a*, 116*b* of the barrier layers 104*a*, 104*b* towards each other. As the barrier layers 104*a*, 104*b* are drawn towards each other, the locking elements 110 attached to the first barrier layer 104*a* engage the locking elements 110 on the opposite barrier layer 104*b* through the opening 158 formed in the biasing element 150*c*. As discussed previously, each of the locking elements 110 include a locking interface 122 configured to cooperate with an interface surface 122 of an opposing locking element 110 through the opening 158 to prevent relative translational movement between the locking elements 110.

With particular reference to FIGS. 10A-10F, a locking structure 100*j* is provided and includes the bladder 102 and a locking system 103*j* disposed within the bladder 102. In view of the substantial similarity in structure and function of the components associated with the locking structure 100*a* with respect to the locking structure 100*j*, like reference numerals are used hereinafter and in the drawings to identify like components while like reference numerals containing letter extensions are used to identify those components that have been modified.

The example of the locking structure 100*j* provided in FIGS. 10A-10F is substantially similar to the locking structure 100*i* described previously, except that the single biasing element 150*c* is only attached to a first series of the locking elements 110. Here, the first series of the locking elements 110 includes an "outer" series of the locking elements 110 disposed on an opposite side of the bladder 102 from the substrate 400. The locking structure 100*j* further includes a second, "inner" series of the sequins arranged along the second barrier layer 104*b* on the same side of the bladder 102 as the substrate 400. The second series of locking elements 110 are not attached to the biasing element 150 and are only attached to the second barrier layer 104*b* at the respective anchors 123*h*. Thus, unlike the locking structure 100*i*, where the first and second series of locking elements 110 of the locking structure 100*i* are attached to the biasing element 150*c* and move between the contracted state and the extended state at the same rate, the first and second series of locking elements 110 of the locking structure 100*j* can move between the contracted state and the extended state independently of each other and at different rates. Furthermore, the biasing force (i.e. towards the contracted state) applied by the biasing element 150 is only applied to the outer series of locking elements while the inner series of locking elements 110 are free to move or float relative to the biasing element 150.

With particular reference to FIGS. 11A-11F, a locking structure 100*k* is provided and includes the bladder 102 and a locking system 103*k* disposed within the bladder 102. In view of the substantial similarity in structure and function of the components associated with the locking structure 100*a* with respect to the locking structure 100*k*, like reference numerals are used hereinafter and in the drawings to identify like components while like reference numerals containing letter extensions are used to identify those components that have been modified.

The example of the locking structure 100*k* provided in FIGS. 11A-11F is substantially similar to the locking structure 100*j* described previously, except that the single biasing element 150*c* is attached to the inner series of locking elements 110 disposed on the same side of the bladder 102 as the substrate 400 while the first, outer series of the locking elements 110 arranged along the outer barrier layer 104*b* on the same side of the bladder 102 as the substrate 400. Thus, like the locking structure 100*j*, the first and second series of locking elements 110 of the locking structure 100*k* can move between the contracted state and the extended state independently of each other and at different rates. Furthermore, the biasing force (i.e. towards the contracted state) applied by the biasing element 150 is only applied to the inner series of locking elements 110 while the outer series of locking elements 110 are free to move or float relative to the biasing element 150.

With particular reference to FIGS. 12A-12F, a locking structure 100I is provided and includes the bladder 102 and a locking system 103I disposed within the bladder 102. In view of the substantial similarity in structure and function of the components associated with the locking structure 100*a* with respect to the locking structure 100I, like reference numerals are used hereinafter and in the drawings to identify like components while like reference numerals containing letter extensions are used to identify those components that have been modified.

The locking structure 100I includes a first biasing element 150*d* disposed between a first series of locking elements 110 and the first barrier layer 104*a* and a second biasing element 150*e* disposed between a second series of locking elements 110 and the second barrier layer 104*b*. Thus, unlike the previous examples where the biasing elements 150-150*c* are disposed between the first and second series of locking elements 110, the locking structure 100I is configured such that the first and second series of locking elements 110 are disposed between the biasing elements 150*d*, 150*e*. Here, each of the biasing elements 150*d*, 150*e* provides a connection interface between a series of the locking elements 110 and a respective one of the barrier layers 104*a*, 104*b*. Optionally, the biasing elements 150*d*, 150*e* may include the opening 158 to allow an interior portion of each locking element 110 to be attached to the inner surfaces 116*a*, 116*b* of the barrier layers 104*a*, 104*b*. In other examples, the biasing elements 150*d*, 150*e* may be formed as continuous and uninterrupted components without the opening 158, such that the locking elements 110 attach directly to the biasing elements 150*d*, 150*e*.

With particular reference to FIGS. 13A-13F, a locking structure 100*m* is provided and includes the bladder 102 and a locking system 103*m* disposed within the bladder 102. In view of the substantial similarity in structure and function of the components associated with the locking structure 100*a* with respect to the locking structure 100*m*, like reference numerals are used hereinafter and in the drawings to identify like components while like reference numerals containing letter extensions are used to identify those components that have been modified.

The locking structure 100*m* is substantially similar to the locking structure 100I, except that the locking structure 100*m* does not include the second biasing element 150*e*. Instead, the locking structure 100*m* only includes the first biasing element 150*d* disposed between and connecting the first series of locking elements 110 to the first, outer barrier layer 104*a*. Here, the second series of locking elements 110 are attached directly to the second, inner barrier layer 104*b*.

With particular reference to FIGS. 14A-14F, a locking structure 100*n* is provided and includes the bladder 102 and a locking system 103*n* disposed within the bladder 102. In view of the substantial similarity in structure and function of the components associated with the locking structure 100*a* with respect to the locking structure 100*n*, like reference numerals are used hereinafter and in the drawings to identify like components while like reference numerals containing letter extensions are used to identify those components that have been modified.

The locking structure 100*n* is substantially similar to the locking structure 100*m*, except that the locking structure 100*m* only includes the second biasing element 150*e* disposed between and connecting the second series of locking elements 110 to the second, inner barrier layer 104*a*. Here, the first series of locking elements 110 are attached directly to the first, inner barrier layer 104*b*.

With particular reference to FIGS. 15A-15F, a locking structure 100*p* is provided and includes the bladder 102 and a locking system 103*p* disposed within the bladder 102. In view of the substantial similarity in structure and function of the components associated with the locking structure 100*a* with respect to the locking structure 100*p*, like reference numerals are used hereinafter and in the drawings to identify like components while like reference numerals containing letter extensions are used to identify those components that have been modified.

Figure 15A:
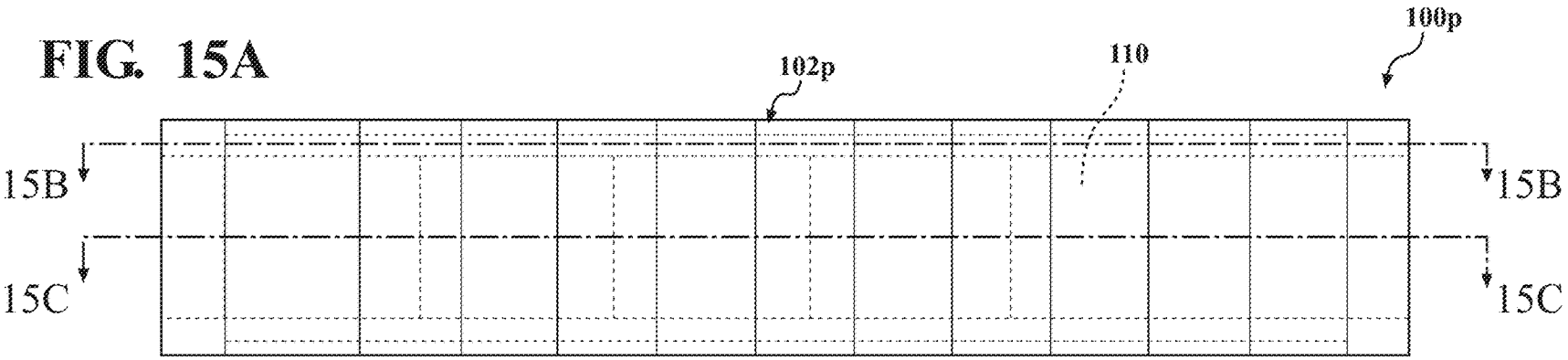
FIG. 15A is a plan view of an example of a locking structure according to the present disclosure, where the locking structure is in an unlocked state.
Figure 15B:
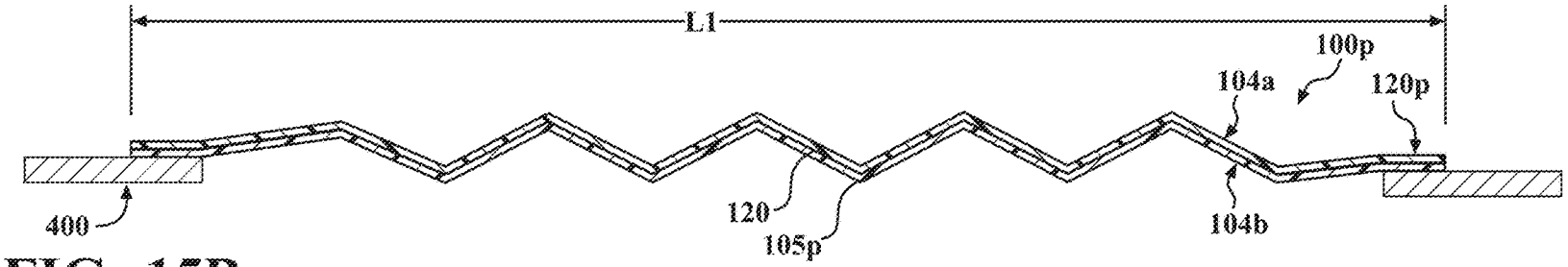
FIG. 15B is a cross-sectional view of the locking structure of FIG. 15A, taken along Line 15B-15B of FIG. 15A.
Figure 15C:
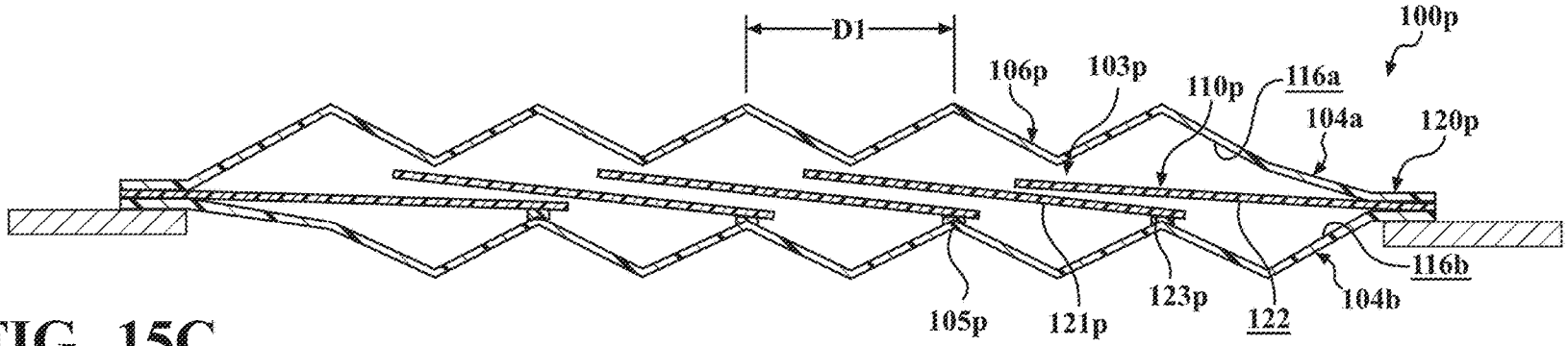
FIG. 15C is a cross-sectional view of the locking structure of FIG. 15A, taken along Line 15C-15C of FIG. 15A.
Figure 15D:
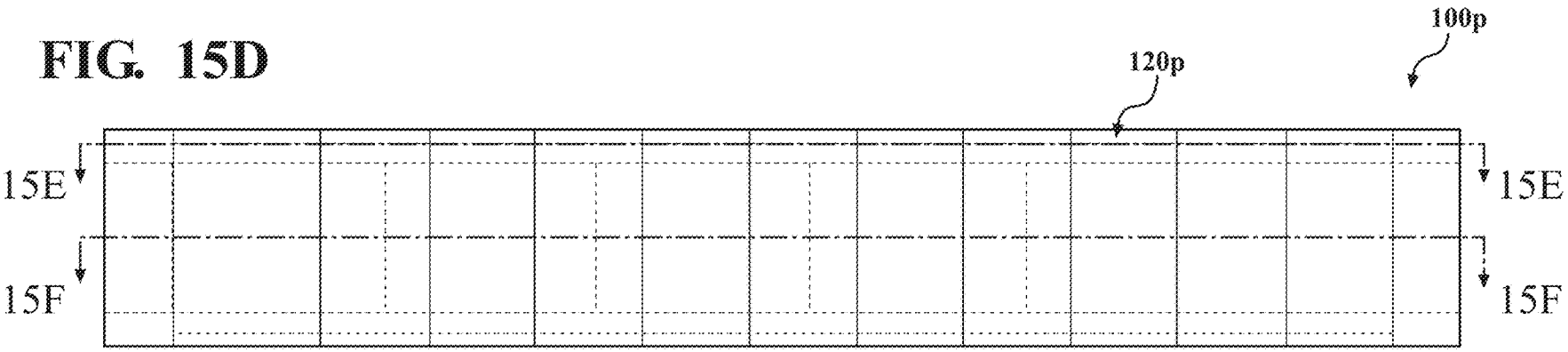
FIG. 15D is a plan view of the locking structure of FIG. 15A, where the locking structure is in a locked state.
Figure 15E:
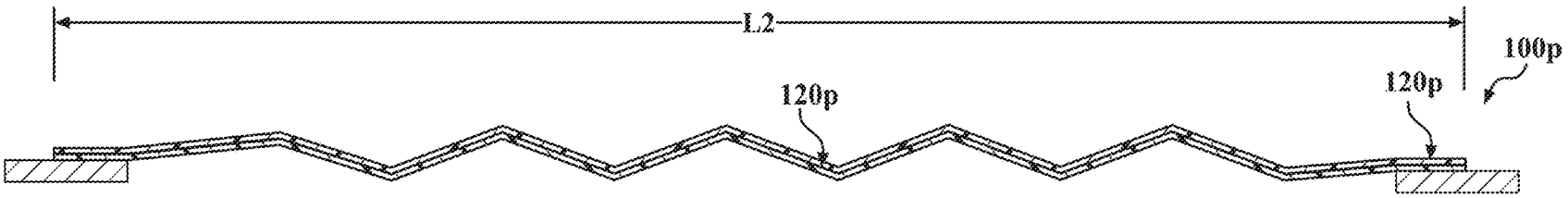
FIG. 15E is a cross-sectional view of the locking structure of FIG. 15A, taken along Line 15E-15E of FIG. 15A.
Figure 15F:
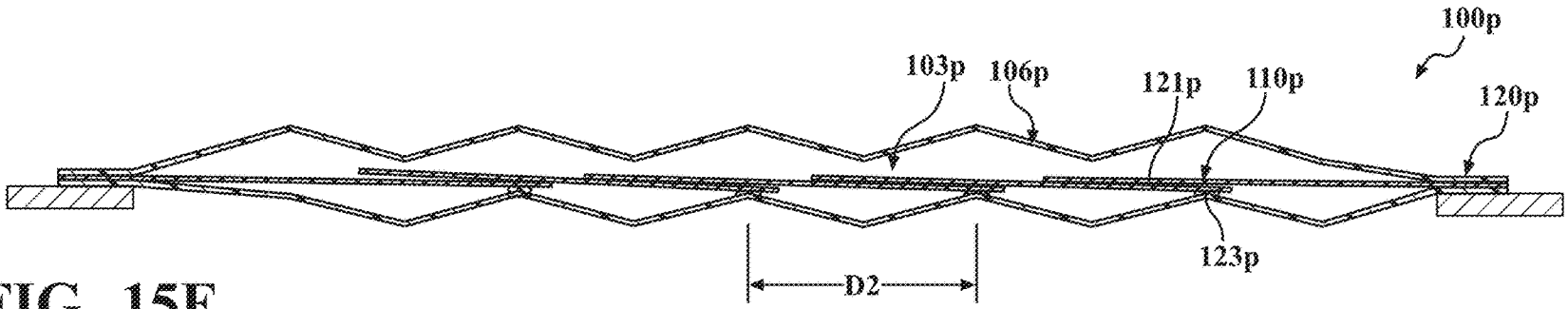
FIG. 15F is a cross-sectional view of the locking structure of FIG. 15A, taken along Line 15F-15F of FIG. 15A.

The locking structure 100*p* of FIGS. 15A-15F includes a bladder 102*p* having a contoured peripheral seam 120*p* forming a collapsible chamber 106*p*. Here, the peripheral seam 120*p* is formed to include a plurality of flexion joints 105*p* along which the peripheral seam 120*p* can fold or collapse when the bladder 102*p* moves between the contracted state (FIGS. 15A-15C) and the extended state (FIGS. 15D-15F). In other words, the flexion joints 105*p* provide predetermine points along the peripheral seam 120*p* along which the bladder 102*p* can transition. Thus, the flexion joints 105*p* can be arranged to provide the bladder 102*p* with predetermined transition pattern. In contrast, bladders including convention peripheral seams (e.g., without flexion joints) may collapse or collect in an unpredictable manner, which may result in a less controlled aesthetic (e.g., crumpling) when a locking structure transitions between the contracted state and the extended state.

With continued reference to FIGS. 15A-15F, the locking structure 100*p* includes a locking system 103*p* having a plurality of cantilevered locking elements 110*p* including a locking body 121*p* and an anchor 123*p* disposed closer to one end of the locking body 121*p*. For example, the anchor 123*p* may be disposed adjacent to a first end of the locking body 121*p* such that the locking body 121*p* extends in one direction from the anchor 123*p*. In the illustrated example, the locking body 121*p* is only anchored to the second, inner barrier layer 104*b*. However, the locking body 121*p* may be anchored to the first, outer barrier layer 104*a*. Additionally, the locking body 121*p* of each locking element 110*p* is anchored to the second barrier layer 104*b* at one of the flexion joints 105*p*.

With reference to FIG. 15C, the locking elements 110*p* are arranged in an overlapping series, wherein a distal end (i.e., the opposite end from the anchor 123) of a locking body 121*p* of a first locking element 110*p* overlaps the proximal end (i.e., the anchored end) of the locking body 121*p* of an adjacent one of the locking elements 110*p*. Thus, an inner or bottom side of the first locking element 110*p* interfaces with an outer or top side of the second locking element 110. This configuration may be referred to as a scale-like sequin structure corresponding to overlapping relationship formed by scales of a fish or other animals.

In use, adjacent ones of the locking elements 110*p* are spaced apart from each other when the locking structure 100*p* is configured in the relaxed, unlocked state such that the bladder 102*p* can freely move between the contracted state and the extended state. The locking structure 100*p* can move between the contracted state having the first length L1 and the extended state having the second length L2 by flexing along the flexion joints 105*p*. When the locking structure 100*p* is at a length corresponding to a desired fit of the locking structure 100*p* around the body, the locking structure 100*p* can move from the unlocked state to the locked state by decreasing the pressure (i.e., pulling a vacuum) within the interior void 108 to draw the first barrier layer 104*a*, 104*b* towards each other. Here, the inner or bottom side of the of each locking element 110 engages the outer or top side of an adjacent one of the locking elements 110 to prevent relative movement between the locking elements 110, thereby locking the length of the locking structure 100*p*.

FIGS. 16A-16E illustrate various geometries of a plurality of locking elements 110*a*-110*e*. As discussed above, the plurality of locking elements 110*a*-110*e* are arranged in an overlapping manner to allow interface surfaces 122 of each locking element 110*a*-110*e* in the plurality of locking elements 110*a*-110*e* to contact one another and form a rigid locking layer 112. The shape of the locking elements 110 used in the plurality of locking elements 110*a*-110*e* will impact the contacting overlap of the interface surfaces 122 between each adjacent locking element 110*a*-110*e*. In some examples, the locking elements 110-110*f* may include a laminate or composite structure including a first material having a first rigidity or elasticity forming a structural base layer of the locking element and one or more exterior surface layers providing desired frictional properties to the locking elements 110-110*f*.

Figure 16A:
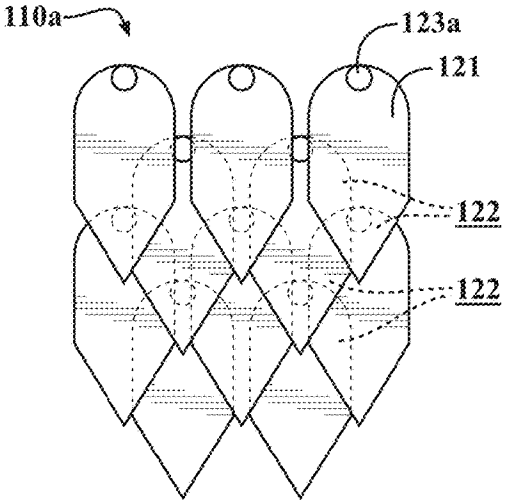
FIGS. 16A-16E show example swatches of locking elements for a locking layer according to the present disclosure.

For example, FIG. 16A shows a plurality of locking elements 110*a* that include a generally rounded first end, a tapered second end on the opposite side of the locking element 110*a* than the first end, and an elongated intermediate portion disposed between the first end and the second end. As shown, the plurality of locking elements 110*a* has a greater overlap of the interface surfaces 122 than the plurality of locking elements 110*b*-110*e*.

Figure 16B:
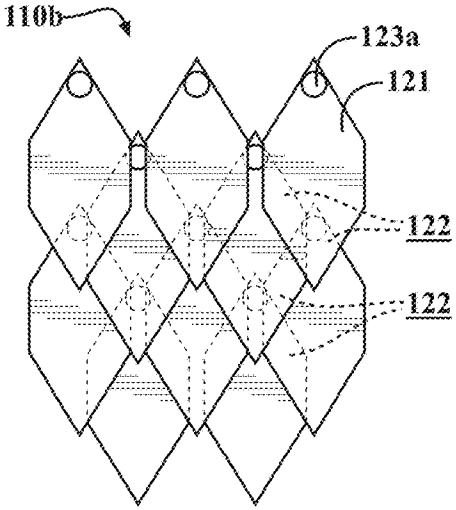
Figure 16C:
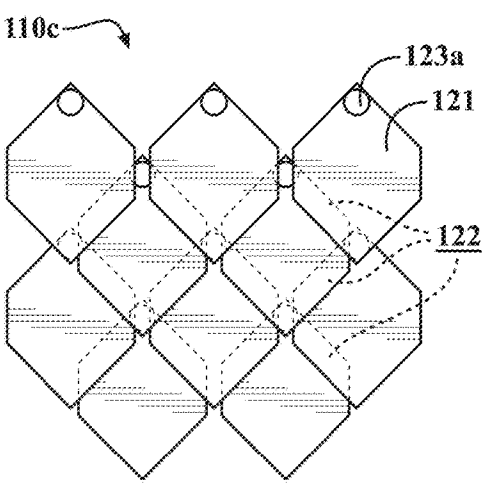
Figure 16D:
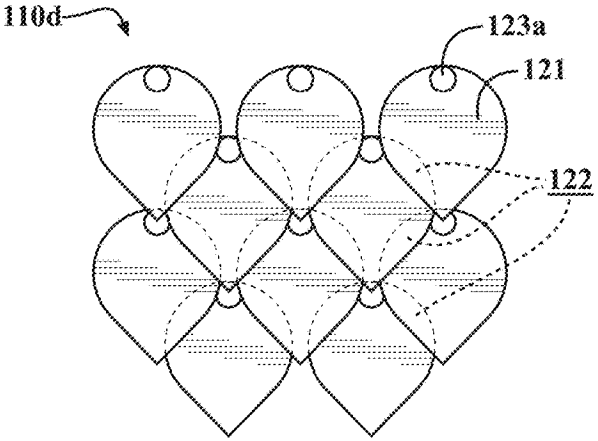
Figure 16E:
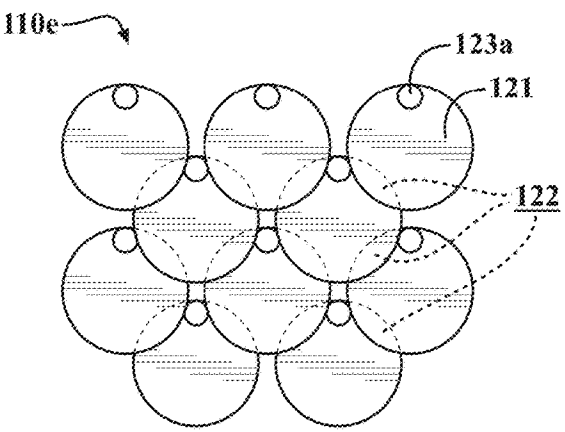

FIG. 16B shows a plurality of locking elements 110*b* that are generally shaped as elongated hexagons having a pair of tapered ends and a substantially straight intermediate portion. Alternatively, a plurality of locking elements 110*c* may be shaped in a shortened hexagon (FIG. 16C) including a pair of tapered ends and a straight intermediate portion having a length less than the length of the intermediate portion of the locking elements 110*b*. In some examples (FIG. 16D), a plurality of locking elements 110*d* are shaped as teardrops, with a rounded first end and a tapered second end extending directly from the first end on an opposite side of the locking element 110*d*. In other examples (FIG. 16E), a plurality of locking elements 110*e* are circle-shaped.

Figure 17A:
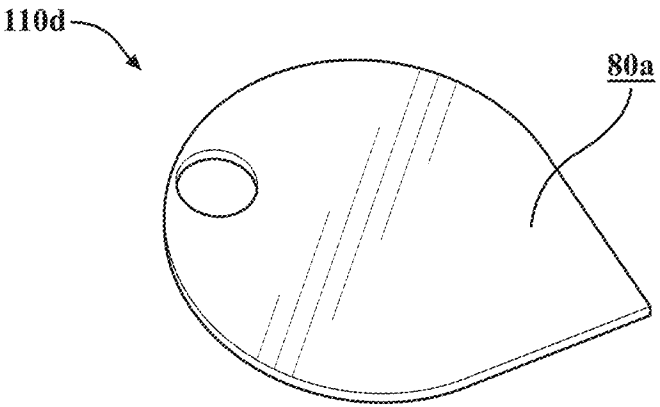
FIGS. 17A-17D show example swatches of locking elements.
Figure 17B:
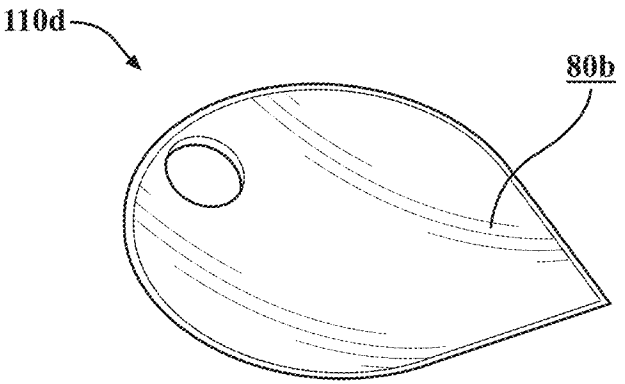
Figure 17C:
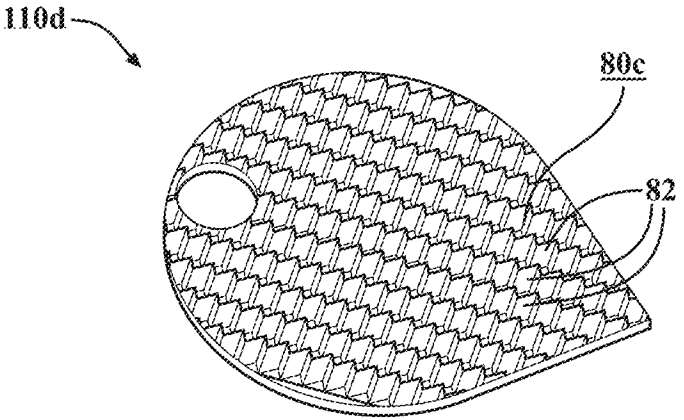
Figure 17D:
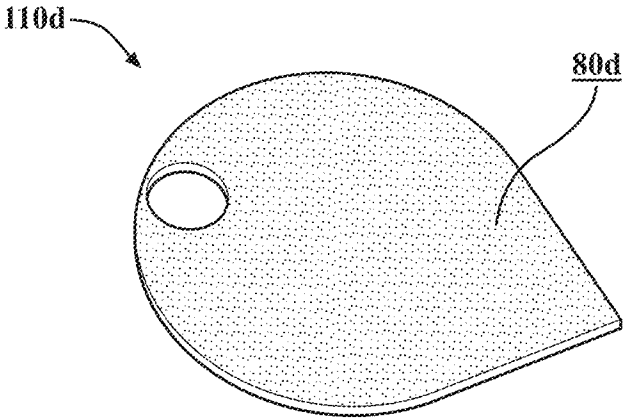

FIGS. 17A-17D illustrate various surfaces of an example locking element. While FIGS. 17A-17D show the teardrop shape of the plurality of locking elements 110*d*, any of the previously discussed shapes may also be used. As discussed above, the plurality of locking elements 110-110*f* may include a high-friction material disposed on the interface surfaces 122. For example, the locking element 110*d* of FIG. 17A may have a smooth surface 80*a* formed by a thermoplastic polyurethane or any other material that exhibits a frictional hold when brought into contact with itself. In some examples, the smooth surface may 80*a* be the result of a film applied to the surface of the locking element 110*d*. In FIG. 17B, the locking element 110*d* includes a concave smooth surface 80*b* that is operable to transition from a concave configuration to a flattened configuration when a pressure is applied to the locking element 110, similar to that described with respect to the locking system 103*f* of FIGS. 6A-6C.

In other examples, the locking element 110*d* may include surface features or texture to create a mechanical lock. For example, in FIG. 17C, the locking element 110*d* includes a textured surface 80*c* including a plurality of teeth 82. When a pressure is applied to the plurality of locking elements 110*d*, the teeth 82 of each locking element 110 slide across the teeth 82 of adjacent locking elements 110 to engage with one another and hold in place. Alternatively, in FIG. 17D, the locking element 110 includes a rough surface 80*d* (e.g., a grit). When a pressure is applied, the rough surface 80*d* of the locking element 110 engages with the rough surfaces 80*d* of adjacent locking elements 110*d*, which are held in place by friction between the engaged rough surfaces 80*d*.

Accordingly, when one locking element 110*a*-110*f* in the plurality of locking elements 110 is brought into contact with a second locking element 110*a*-110*f* in the plurality of locking elements 110, both of the locking elements create a rigid locking layer 112. Examples of different geometries of locking elements 110 are discussed below with respect to FIGS. 16A-16E.

Figure 18:
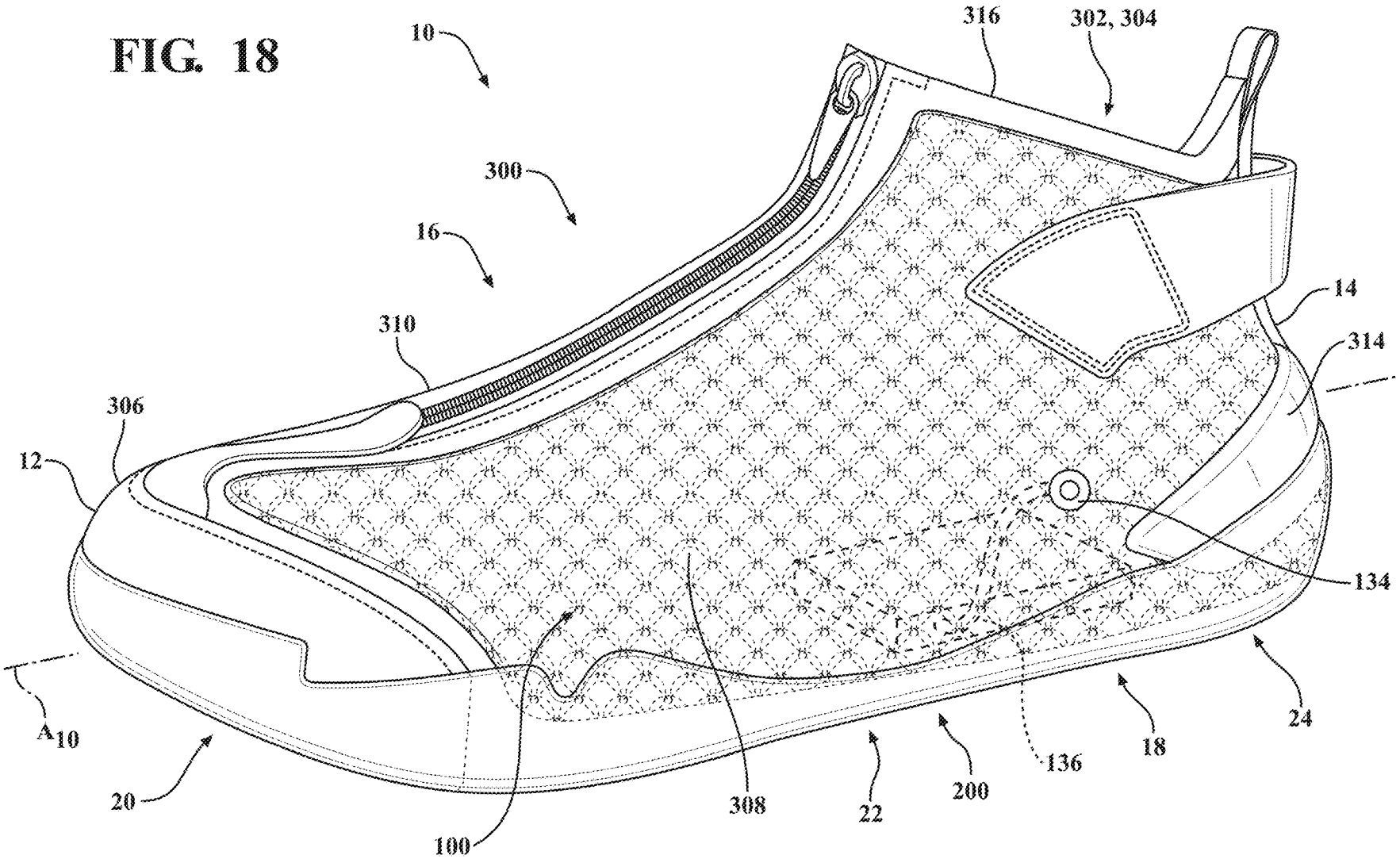
FIGS. 18 and 19 are front perspective views of an article of footwear incorporating a locking structure.

Referring to FIG. 18, an article of footwear includes an upper 300 and a sole structure 200 attached to the upper 300. The footwear 10 may further include an anterior end 12 associated with a forward-most point of the footwear, and a posterior end 14 corresponding to a rearward-most point of the footwear 10. A longitudinal axis A10 of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 is associated with phalanges and metatarsal bones of a foot. The mid-foot region 22 may correspond with an arch area of the foot, and the heel region 24 may correspond with rear portions of the foot, including a calcaneus bone.

The upper 300 defines an interior void 302 and an ankle opening 304, which cooperate to receive and secure a foot for support on the sole structure 200. The upper 300, and components thereof, may be described as including various subcomponents or regions. For example, the upper 300 includes a toe cap 306 disposed at the anterior end 12 and extending over the toes from the medial side 16 to the lateral side 18. A pair of side panels 308 extend from the toe cap 306 in the mid-foot region 22 on opposite sides of the interior void 302 to a heel counter 314 that wraps around the posterior end of the footwear 10. A throat 310 extends across the top of the upper 300 and defines an instep region extending between the side panels 308 from the toe cap 306 to the ankle opening 304. In the illustrated example, the throat 310 is enclosed, whereby a material panel extends between the opposing side panels 308 in the instep region to cover the interior void 302. Here, the material panel covering the throat 310 may be formed of a material having a higher modulus of elasticity than the material forming the side panels 308. Uppermost edges of the throat 310, the side panels 308, and the heel counter 314 cooperate to form a collar 316, which defines the ankle opening 304 of the interior void 302.

In the example of FIGS. 18, the upper 300 includes the locking structure 100 incorporated into the side panels 308. By incorporating the locking structure 100 into the upper 300, the article of footwear is operable to transition between a relaxed state and a locked state. In use, the upper 300 is moved between the unlocked relaxed state and the locked constricted state by adjusting the pressure of the locking structure 100. For example, an athlete steps into the article of footwear 10 while it is in the relaxed state to accommodate the athlete's foot. Once in position within the article of footwear 10, the athlete may apply any means of negative pressure (e.g., vacuum, external force, etc.) to transition the locking structure 100 incorporated into the upper 300 to the locked and constricted state to conform the upper 300 to the athlete's foot, as discussed above with respect to the examples of FIGS. 1A-6C.

Figure 19:
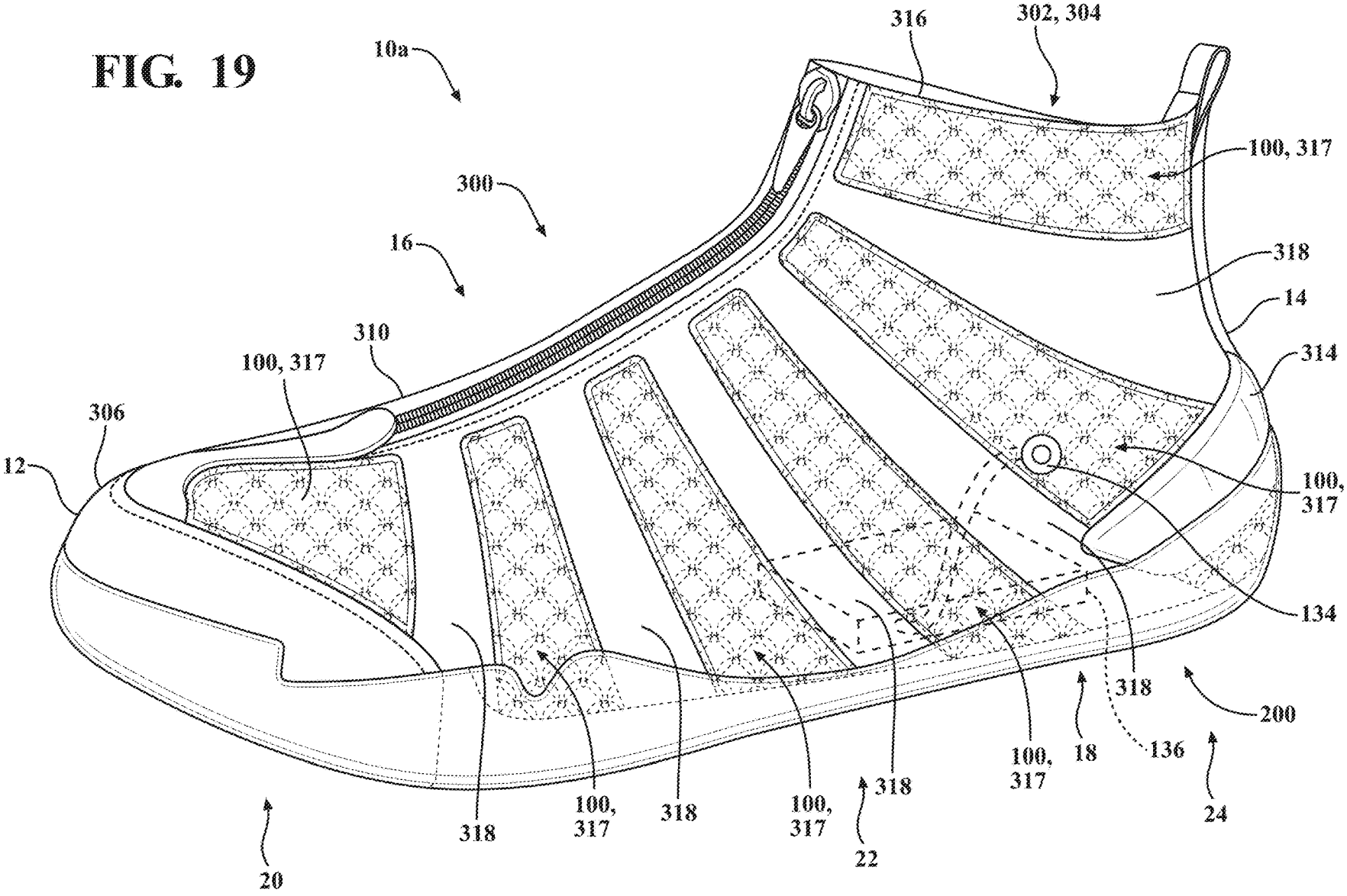

With particular reference to FIG. 19, another example of a configuration of an article of footwear 10*a* having a locking structure 100 incorporated into the upper 300 is provided. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the example shown in FIG. 19, the locking structure 100 is selectively incorporated into the upper 300 of the article of footwear 10*a*. As shown, the locking structure 100 is placed in zones 317 that facilitate the locked state of the article of footwear 10*a*, while also maintaining bands 318 without a locking structure 100 to allow more flexibility of the upper 300 when accommodating an athlete's foot during entry and removal from the footwear 10*a*. Once the athlete has placed a foot within the article of footwear 10*a*, the athlete may apply any means of pressure (e.g., vacuum, external force, etc.) to transition the zones of the locking structure 100 into a locked state while allowing the bands 318 to stay in a relaxed state.

In use, the locking structure 100 is moved between the relaxed state and the locked state by adjusting the fluid pressure within the interior void 108 of the chamber 106. For example, the pressure within the interior void 108 may be reduced by drawing a vacuum within the interior void through a port 134 attached to the bladder 102.

Figure 20:
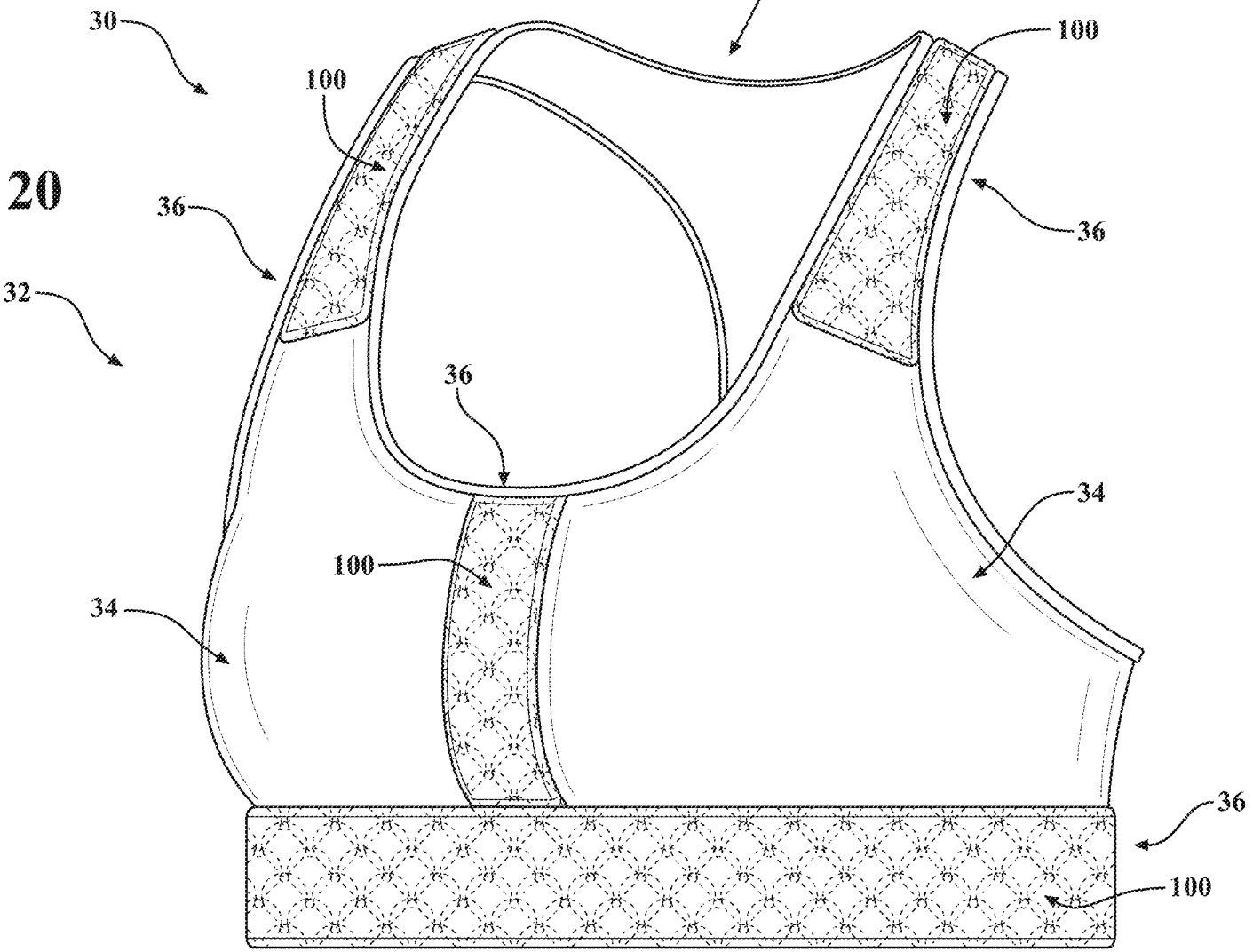
FIG. 20 is a perspective view of an article of clothing incorporating a locking structure.

Referring to FIG. 20, the locking structure 100 may be incorporated into an article of clothing such as a sports bra 30. In this example, the sports bra 30 may be made of a flexible material 32 that includes relaxed zones 34 and locking zones 36. The locking zones 36 may include the locking structure 100, and can transition between an unlocked state (e.g., when putting on or taking off the sports bra 30), and a locked state (e.g., when wearing the sports bra 30). In use, both the relaxed zones 34 and the locking zones 36 begin in a relaxed state. Once the athlete has positioned the sports bra 30, the athlete may apply any means of negative pressure (e.g., vacuum, external force, etc.) to transition the locking zones 36 incorporating the locking structure 100 from the unlocked state to the locked state.

The following Clauses provide an exemplary configuration for a locking structure for an article of footwear or apparel, an article of footwear, and an article of apparel described above.

Clause 1. A locking structure for an article, the locking structure comprising a bladder including a first barrier element attached to a second barrier element to define a chamber having an interior void and a plurality of locking elements disposed within the interior void and each attached to at least one of the first barrier element and the second barrier element, each of the locking elements including an interface surface operable to selectively engage an interface surface of another one of the locking elements.

Clause 2. The locking structure of Clause 1, wherein each of the locking elements includes an anchor attached to an inner surface of one of the first barrier element and the second barrier element.

Clause 3. The locking structure of any of the preceding Clauses, wherein each of the locking elements includes a locking body including the interface surface.

Clause 4. The locking structure of Clause 3, wherein each of the locking elements includes a pair of interface surfaces disposed on opposite sides of the locking body.

Clause 5. The locking structure of Clause 3, wherein the locking body is contoured.

Clause 6. The locking structure of any of the preceding Clauses, further comprising a port in fluid communication with the interior void.

Clause 7. The locking structure of any of the preceding Clauses, further comprising a compressible component disposed within the interior void.

Clause 8. The locking structure of Clause 7, wherein the bladder includes a third barrier element attached to the first barrier element and the second barrier element, the third barrier element formed within the chamber to define a first subchamber having a first interior void and a second subchamber having a second interior void.

Clause 9. The locking structure of Clause 8, wherein the plurality of locking elements are disposed within the first interior void and the compressible component is disposed within the second interior void.

Clause 10. The locking structure of Clause 8, wherein the first subchamber having the first interior void includes a first port in communication with the first interior void, and the second subchamber having the second interior void includes a second port in communication with the second interior void.

Clause 11. A locking structure for an article, the locking structure comprising a bladder including a first barrier element attached to a second barrier element to define a chamber having an interior void and a locking system including locking elements each attached to one of the first barrier element or the second barrier element and including at least one interface surface, the interior void of the bladder operable between a first pressure to move the locking system to a locked state and a second pressure to move the locking system to an unlocked state.

Clause 12. The locking structure of Clause 11, wherein each of the locking elements includes an anchor attached to an inner surface of one of the first barrier element and the second barrier element.

Clause 13. The locking structure of any of the preceding Clauses, wherein each of the locking elements includes a locking body including the interface surface.

Clause 14. The locking structure of Clause 13, wherein each of the locking elements includes a pair of interface surfaces disposed on opposite sides of the locking body.

Clause 15. The locking structure of Clause 13, wherein the locking body is contoured.

Clause 16. The locking structure of any of the preceding Clauses, further comprising a port in fluid communication with the interior void.

Clause 17. The locking structure of any of the preceding Clauses, further comprising a compressible component disposed within the interior void.

Clause 18. The locking structure of Clause 17, wherein the bladder includes a third barrier element attached to the first barrier element and the second barrier element, the third barrier element formed within the chamber to define a first subchamber having a first interior void and a second subchamber having a second interior void.

Clause 19. The locking structure of Clause 18, wherein the locking system is disposed within the first interior void and the compressible component is disposed within the second interior void.

Clause 20. The locking structure of Clause 18, wherein the first subchamber having the first interior void includes a first port in communication with the first interior void, and the second subchamber having the second interior void includes a second port in communication with the second interior void.

Clause 21. An upper for an article of footwear including the locking structure of any of Clauses 1-20.

Clause 22. An article of apparel including the locking structure of any of Clauses 1-20.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A locking structure for an article, the locking structure comprising:

a bladder including a first barrier element attached to a second barrier element to define a chamber having an interior void; and a plurality of locking elements disposed within the interior void and each attached to at least one of the first barrier element and the second barrier element, each of the locking elements including an interface surface operable to selectively engage an interface surface of another one of the locking elements.

2. The locking structure of claim 1, wherein each of the locking elements includes an anchor attached to an inner surface of one of the first barrier element and the second barrier element.

3. The locking structure of claim 1, wherein each of the locking elements includes a locking body including the interface surface.

4. The locking structure of claim 3, wherein each of the locking elements includes a pair of interface surfaces disposed on opposite sides of the locking body.

5. The locking structure of claim 1, further comprising a port in fluid communication with the interior void.

6. A locking structure for an article, the locking structure comprising:

a bladder including a first barrier element attached to a second barrier element to define a chamber having an interior void; and a locking system including locking elements each attached to one of the first barrier element or the second barrier element and including at least one interface surface, the interior void of the bladder operable between a first pressure to move the locking system to a locked state and a second pressure to move the locking system to an unlocked state.

7. The locking structure of claim 6, wherein each of the locking elements includes an anchor attached to an inner surface of one of the first barrier element and the second barrier element.

8. The locking structure of claim 6, wherein each of the locking elements includes a locking body including the interface surface.

9. The locking structure of claim 8, wherein each of the locking elements includes a pair of interface surfaces disposed on opposite sides of the locking body.

10. The locking structure of claim 6, further comprising a port in fluid communication with the interior void.

* * * * *